US011073771B2

(12) United States Patent
Hasegawa et al.

(10) Patent No.: US 11,073,771 B2
(45) Date of Patent: Jul. 27, 2021

(54) ELECTROPHOTOGRAPHIC PHOTOCONDUCTOR, METHOD OF MANUFACTURING THE SAME, AND ELECTROPHOTOGRAPHIC DEVICE INCLUDING THE SAME

(71) Applicant: FUJI ELECTRIC CO., LTD., Kawasaki (JP)

(72) Inventors: Tomoki Hasegawa, Hino (JP); Shinjiro Suzuki, Matsumoto (JP); Fengqiang Zhu, Matsumoto (JP)

(73) Assignee: FUJI ELECTRIC CO., LTD., Kawasaki (JP)

( * ) Notice: Subject to any disclaimer, the term of this patent is extended or adjusted under 35 U.S.C. 154(b) by 0 days.

(21) Appl. No.: 16/888,751

(22) Filed: May 31, 2020

(65) Prior Publication Data

US 2021/0026259 A1 Jan. 28, 2021

(30) Foreign Application Priority Data

Jul. 24, 2019 (JP) ..... JP2019-136395

(51) Int. Cl.
*G03G 5/06* (2006.01)
*G03G 5/047* (2006.01)
(Continued)

(52) U.S. Cl.
CPC ..... *G03G 5/047* (2013.01); *G03G 5/0525* (2013.01); *G03G 5/0564* (2013.01);
(Continued)

(58) Field of Classification Search
None
See application file for complete search history.

(56) References Cited

U.S. PATENT DOCUMENTS

2006/0134540 A1 6/2006 Kondo et al.
2018/0224760 A1 8/2018 Suzuki et al.
(Continued)

FOREIGN PATENT DOCUMENTS

JP S6162040 A 3/1986
JP H01205171 A 8/1989
(Continued)

*Primary Examiner* — Peter L Vajda
(74) *Attorney, Agent, or Firm* — Rabin & Berdo, P.C.

(57) ABSTRACT

An electrophotographic photoconductor includes a conductive substrate; and a photosensitive layer provided on the conductive substrate and containing a charge generation material, a hole transport material, a first electron transport material, from 3% by mass to 40% by mass of a second electron transport material, a resin binder, and an inorganic oxide filler surface-treated with a silane coupling agent. In a dipole-dipole force component (a Hansen solubility parameter), the first electron transport material and the silane coupling agent have a difference of $\Delta SPa<2.50$; the second electron transport material and the silane coupling agent have a difference of $\Delta SPb<2.50$; and the first electron transport material and the second electron transport material have a difference of $0.30<\Delta SPc<1.00$. In a London dispersion force component (a Hansen solubility parameter), the resin binder and the silane coupling agent have a difference of $\Delta SPd<2.00$.

20 Claims, 4 Drawing Sheets

(51) Int. Cl.
*G03G 5/087* (2006.01)
*G03G 5/05* (2006.01)

(52) U.S. Cl.
CPC ..... *G03G 5/0614* (2013.01); *G03G 5/0646* (2013.01); *G03G 5/087* (2013.01)

(56) References Cited

U.S. PATENT DOCUMENTS

| | | | | |
|---|---|---|---|---|
| 2018/0275537 | A1* | 9/2018 | Hasegawa ..... | G03G 5/0564 |
| 2018/0356744 | A1* | 12/2018 | Shimizu ..... | G03G 5/0614 |

FOREIGN PATENT DOCUMENTS

| | | | |
|---|---|---|---|
| JP | H07333881 | A | 12/1995 |
| JP | H08305051 | A | 11/1996 |
| JP | 2004143028 | A | 5/2004 |
| JP | 2006201744 | A | 8/2006 |
| JP | 2006301247 | A | 11/2006 |
| JP | 2013224225 | A | 10/2013 |
| JP | 2014146001 | A | 8/2014 |
| JP | 2015094839 | A | 5/2015 |
| JP | 2015175948 | A | 10/2015 |
| JP | 2018004695 | A | 1/2018 |
| JP | 2018017765 | A | 2/2018 |
| WO | 2017110300 | A1 | 6/2017 |
| WO | 2018003229 | A1 | 1/2018 |
| WO | 2019142608 | A1 | 7/2019 |

* cited by examiner

ELECTROPHOTOGRAPHIC PHOTOCONDUCTOR, METHOD OF MANUFACTURING THE SAME, AND ELECTROPHOTOGRAPHIC DEVICE INCLUDING THE SAME

CROSS REFERENCE TO RELATED APPLICATION(S)

This non-provisional application for a U.S. patent claims the benefit of priority of JP PA 2019-136395 filed Jul. 24, 2019, the entire contents of which is hereby incorporated by reference.

BACKGROUND OF THE INVENTION

1. Field of the Invention

The present invention relates to an electrophotographic photoconductor (hereinafter also simply referred to as "photoconductor") used in electrophotographic printers, copiers, fax machines, and the like, a method of manufacturing the same, and an electrophotographic device including the same.

2. Background of the Related Art

An electrophotographic photoconductor has a basic structure in which a photosensitive layer having a photoconductive function is provided on a conductive substrate. In recent years, research and development of organic electrophotographic photoconductors that use organic compounds as functional components responsible for charge generation and transport have been actively promoted due to the diversity of materials, high productivity, and safety. There has been progress in applying such organic electrophotographic photoconductors to copiers and printers.

In general, a photoconductor is required to have a function of retaining surface charges in a dark place, a function of receiving light to generate charges, and a function of transporting generated charges. There are photoconductors such as a single-layered photoconductor having a single-layered photosensitive layer having these functions and a multi-layered (function separation type) photoconductor having a photosensitive layer in which layers having separate functions, namely a charge generation layer mainly having a function of generating charges during photoreception and a charge transport layer having a function of retaining surface charges in a dark place and a function of transporting charges generated in the charge generation layer, are layered.

The above-described photosensitive layer is usually formed by applying a coating liquid in which a charge generation material, a charge transport material, and a resin binder are dissolved or dispersed in an organic solvent to the conductive substrate. In particular, for the layer that is the outermost surface of the organic photoconductor, using, as a resin binder, polycarbonate that is resistant to friction generated between paper and a blade for removing toner, has excellent flexibility, and has good transparency for exposure is often seen. In particular, bisphenol-Z polycarbonate is widely used as a resin binder.

Meanwhile, as recent electrophotographic devices, digital systems, in which information such as images and characters is digitalized and converted into optical signals using monochromatic light such as argon, helium-neon, a semiconductor laser or a light emitting diode as an exposure light source, and an electrostatic latent image is formed on the surface of a photoconductor by irradiating light of the optical signals on the charged photoconductor to visualizes the electrostatic latent image with toner, have become mainstream.

As a method of charging a photoconductor, there are a non-contact charging method in which a charging member such as a scorotron is not in contact with the photoconductor, and a contact charging method in which a charging member formed with a semiconductive rubber roller or brush comes into contact with the photoconductor. Of these, the contact charging method has a feature that corona discharge occurs in the vicinity of the photoconductor so that ozone is less generated and the applied voltage can be lower, compared with the non-contact charging method. Therefore, a more compact, low-cost, and low-environmentally polluting electrophotographic device can be realized, and in particular, it is the mainstream for medium to small systems.

As a means for cleaning the surface of a photoconductor, scraping-off by a blade, a process of performing cleaning simultaneously with development, and the like are mainly used. In the cleaning process using a blade, the untransferred residual toner on the surface of a photoconductor may be scraped off by a blade and collected in a collection box for waste toner, or may be returned to a developing unit again. Thus, when a cleaner for scraping-off by a blade in such manner is used, a toner collection box or a space for recycling is required, and it is necessary to monitor whether the collection box is full. In addition, if paper dust or external additives stay on the blade, the surface of the photoconductor may be damaged, thereby shortening the life of the photoconductor. Therefore, in some cases, toner may be collected in the developing process, or a process of magnetically or electrically sucking residual toner adhering to the surface of the photoconductor may be provided immediately before the developing process.

When a cleaning blade is used, it is necessary to increase the hardness and contact pressure of the blade in order to improve the cleaning performance. For such a reason, abrasion of the photoconductor surface is promoted, which may cause potential fluctuation or sensitivity fluctuation and an image abnormality, and also may cause a failure in color balance and reproducibility in a color electrophotographic device.

Further, with an increase in the amount of information processing (increase in printing volume) and an increase in the development of and the penetration rate of color printers, higher printing speeds, miniaturization of apparatuses, and reduction in the number of members are progressing. There is also a demand for adaptation to various service environments. Under such circumstances, there has been a remarkably increasing demand for a photoconductor in which fluctuations in image characteristics and electric characteristics due to repeated use and fluctuations in the service environment (room temperature and environment) are small. These requirements cannot be sufficiently satisfied at the same time by the conventional technology. In particular, there is a strong demand for eliminating the problem of print density reduction and ghost images caused by fluctuations in the potential of a photoconductor in a low-temperature environment. Further, the generation of cracks caused by the attachment of sebum derived from the human body to the photoconductor surface also poses a problem.

In order to solve these problems, various methods of improving the outermost surface layer of a photoconductor have been proposed. For example, Patent Documents 1 and 2 propose a method of adding a filler to a surface layer of a photoconductor in order to improve the durability of the surface of the photoconductor. However, it is difficult to uniformly disperse the filler by the method of dispersing the filler in the layer. Further, when the aggregate of the filler is present, the permeability of the layer is reduced, or the filler scatters the exposure light so that the charge transport and the charge generation become non-uniform, and the image characteristics may deteriorate. Further, there is a method of adding a dispersant to improve the dispersibility of the filler. However, in this case, since the dispersant itself affects the photoconductor characteristics, it has been difficult to achieve both the filler dispersibility and the photoconductor characteristics.

In order to solve this problem, for example, Patent Documents 3 and 4 propose a technique for improving the content and dispersion state of a filler. However, the effects of these techniques are not sufficient, and development of an electrophotographic photoconductor which is excellent in printing durability and repetition stability and can achieve high resolution is desired.

In addition, Patent Document 5 discloses an organic photoconductor in which a surface layer contains inorganic particles having a number average primary particle size (Dp) of 5 to 100 nm, the inorganic particles being surface-treated for a plurality of times and then surface-treated with a silazane compound as a final surface treatment. Patent Document 6 discloses an electrophotographic photoconductor in which a photosensitive layer on the outermost surface contains a predetermined amount of silica particles together with a predetermined functional material.

Further, for the improvement of image quality characteristics and electric characteristics against environmental fluctuations and elimination of ghost images, for example, Patent Document 7 teaches that an electrophotographic photoconductor that is highly sensitive and extremely stable with respect to environmental changes was found by using a combination of butanediol-added titanyl phthalocyanine as a charge generation material and a naphthalenetetracarboxylic diimide-based compound as a charge transport material for a photosensitive layer. Furthermore, Patent Document 8 discloses a specific example of a positively charged multilayered electrophotographic photoconductor in which multilayered photosensitive layer is formed by layering a charge transport layer and a charge generation/transport layer in that order on a conductive substrate, the charge generation/transport layer containing a phthalocyanine compound as a charge generation material and a naphthalenetetracarboxylic diimide compound as an electron transport material. Moreover, Patent Document 9 discloses that in a single-layered positively charged photoconductor, crystallization of the photosensitive layer and generation of transfer memory (ghost) are suppressed by using three or more particular electron transport agents to a hole transport material at a fixed ratio. However, printing durability is not sufficient, and it has not been possible to achieve both ghosting suppression and durability.

An object of the present invention is to resolve the above-described problems and provide an electrophotographic photoconductor in which abrasion of a photosensitive layer is reduced, ghosting is suppressed, and favorable images can be stably obtained, a method of manufacturing the same, and an electrophotographic device including the same.

RELATED ART DOCUMENTS—PATENT DOCUMENTS

Patent Document 1: JPH01-205171 A;
Patent Document 2: JPH07-333881 A;
Patent Document 3: JPH08-305051 A;
Patent Document 4: JP2006-201744A;
Patent Document 5: JP2006-301247A;
Patent Document 6: JP2015-175948A;
Patent Document 7: JP2015-094839A;
Patent Document 8: JP2014-146001A; and
Patent Document 9: JP2018-004695A.

SUMMARY OF THE INVENTION

Problems to be Solved by the Invention

As stated above, various studies have been made on the improvement of the photosensitive layer of a photoconductor. However, regarding the techniques disclosed in Patent Documents described above, the study of the relationship between the materials constituting the photosensitive layer has not been sufficiently conducted, and it has not been possible to stably and satisfactorily secure the electrical characteristics and image characteristics while sufficiently reducing the abrasion amount on the surface of the photoconductor.

Means for Solving the Problems

As a result of intensive studies, the present inventors found that an electrophotographic photoconductor with a small abrasion amount of a photosensitive layer and a small ghost image level can be provided by compounding a specific combination of two types of electron transport materials, a resin binder, and a filler surface-treated with a silane coupling agent into a photosensitive layer.

A first aspect of the present invention is an electrophotographic photoconductor, including: a conductive substrate; and a photosensitive layer provided on the conductive substrate and containing a charge generation material, a hole transport material, a first electron transport material, a second electron transport material, a resin binder, and an inorganic oxide filler surface-treated with a silane coupling agent, wherein the first electron transport material and the silane coupling agent have a difference $\Delta SPa$ in a dipole-dipole force component, that is a Hansen solubility parameter, between the first electron transport material and the silane coupling agent that satisfies a relationship of $\Delta SPa<2.50$, wherein the second electron transport material and the silane coupling agent have a difference $\Delta SPb$ in a dipole-dipole force component, that is a Hansen solubility parameter, between the second electron transport material and the silane coupling agent that satisfies a relationship of $\Delta SPb<2.50$, wherein the first electron transport material and the second electron transport material have a difference $\Delta SPc$ in a dipole-dipole force component, that is a Hansen solubility parameter, between the first electron transport material and the second electron transport material that satisfies a relationship of $0.30<\Delta SPc<1.00$, wherein the resin binder and the silane coupling agent have a difference $\Delta SPd$ in a London dispersion force component, that is a Hansen solubility parameter, between the resin binder and the silane coupling agent that satisfies a relationship of $\Delta SPd<2.00$, and wherein the second electron transport material is present in an amount ranging from 3% by mass to 40% by mass with respect to combined content of the first electron transport material and the second electron transport material.

Here, Hansen solubility parameters are calculated using the Hansen's formula by which the interaction of intermolecular forces can be divided into a London dispersion force component, a dipole-dipole force component, and a hydrogen bonding force component.

Of these, the dipole-dipole force component δp that is a Hansen solubility parameter is calculated by the following equation:

$$\delta p=\sqrt{\Sigma Fp^2/V}(J^{1/2}/cm^{3/2}),$$

where Fp is cohesive energy of a Krevelen and Hoftyzer parameter related to a dipole of each component, and V is the molar volume of each component.

In addition, a London dispersion force component δd that is a Hansen solubility parameter is calculated by the following equation:

$$\delta d=\Sigma Fd/V(J^{1/2}/cm^{3/2}),$$

where Fd is cohesive energy of a Krevelen and Hoftyzer parameter related to a London dispersion force of each component, and V is the molar volume of each component.

It is noted that, according to the present invention, in order to take the difference between two materials for each solubility parameter described above, the dipole-dipole force component that is a Hansen solubility parameter is denoted by SPa, SPb, and SPc, and the London dispersion force component that is a Hansen solubility parameter is denoted by SPd.

Regarding the above-described equations, the value corresponding to the cohesive energy density and the value of the molar volume for each component are stored in a database for each atomic group (Krevelen and Hoftyzer parameter) and introduced in references.

The present inventors obtained each of Hansen solubility parameters of photoconductor materials, and studied the correlation between compatibility and filler dispersibility between first and second electron transport materials and a silane coupling agent, the correlation between compatibility and filler dispersibility between first and second electron transport materials, and the correlation between compatibility and filler dispersibility between a resin binder and a silane coupling agent. As a result of the studies, it was found that filler dispersibility is highly correlated to a difference in a dipole-dipole force component between a first and second electron transport material and a silane coupling agent and between first and second electron transport materials and a difference in a London dispersion force component between a resin binder and a silane coupling agent.

According to the studies made by the present inventors, in materials of a photosensitive layer, it is possible to obtain a photoconductor having excellent printing durability and ghost image-reducing effects, when a difference ΔSPa in a dipole-dipole force component between a first electron transport material and a silane coupling agent, a difference ΔSPb in a dipole-dipole force component between a second electron transport material and a silane coupling agent, a difference ΔSPc in a dipole-dipole force component between a first electron transport material and a second electron transport material, and a difference ΔSPd in a London dispersion force component between a resin binder and a silane coupling agent satisfy relationships represented by the following expressions (i) to (iv), respectively:

$$\Delta SPa<2.50 \quad \text{(i)},$$

$$\Delta SPb<2.50 \quad \text{(ii)},$$

$$0.30<\Delta SPc<1.00 \quad \text{(iii), and}$$

$$\Delta SPd<2.00 \quad \text{(iv)}.$$

It is considered that in the composition of the photosensitive layer, by selecting a combination of materials which allows the values of ΔSPa, ΔSPb, and ΔSPd to fall within the above-described ranges, the filler contained in the photosensitive layer is sufficiently dispersed and the film strength is improved so that abrasion resistance is improved, and further, by selecting a combination of two types of electron transport materials which allows the value of ΔSPc to fall within the above-described range, favorable compatibility, suppression of electron trap formation, and reduction of ghosting are achieved.

It is preferable that the first electron transport material and the second electron transport material are selected from compounds represented by the following general formulas (ET1) and (ET2):

(ET1)

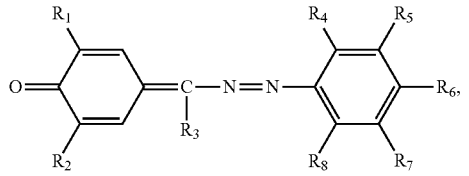

where $R_1$ and $R_2$ are the same or different and each represent a hydrogen atom, an alkyl group having 1 to 12 carbon atoms, an alkoxy group having 1 to 12 carbon atoms, an aryl group which may have a substituent, a cycloalkyl group, an aralkyl group which may have a substituent, or an alkyl halide group, $R_3$ represents a hydrogen atom, an alkyl group having 1 to 6 carbon atoms, an alkoxy group having 1 to 6 carbon atoms, an aryl group which may have a substituent, a cycloalkyl group, an aralkyl group which may have a substituent, or an alkyl halide group, $R_4$ to $R_8$ are the same or different and each represent a hydrogen atom, a halogen atom, an alkyl group having 1 to 12 carbon atoms, an alkoxy group having 1 to 12 carbon atoms, an aryl group which may have a substituent, an aralkyl group which may have a substituent, a phenoxy group which may have a substituent, an alkyl halide group, a cyano group, or a nitro group with a condition that two or more groups may be combined to form a ring, and each substituent represents a halogen atom, an alkyl group having 1 to 6 carbon atoms, an alkoxy group having 1 to 6 carbon atoms, a hydroxyl group, a cyano group, an amino group, a nitro group, or an alkyl halide group; and (ET2)

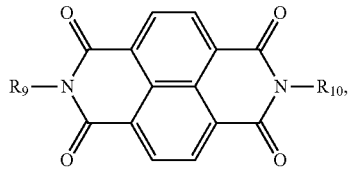

where $R_9$ and $R_{10}$ are the same or different and each represent a hydrogen atom, a halogen atom, a cyano group, a nitro group, a hydroxyl group, an alkyl group having 1 to 12 carbon atoms, an alkoxy group having 1 to 12 carbon atoms, an aryl group which may have a substituent, a heterocyclic group which may have a substituent, an ester group, a cycloalkyl group, an aralkyl group which may have a substituent, an allyl group, an amide group, an amino group, an acyl group, an alkenyl group, an alkynyl group, a carboxyl group, a carbonyl group, a carboxylic acid group, or an alkyl halide group, and each substituent represents a halogen atom, an alkyl group having 1 to 6 carbon atoms, an alkoxy group having 1 to 6 carbon atoms, a hydroxyl group, a cyano group, an amino group, a nitro group, or an alkyl halide group.

It is also preferable that the first electron transport material and the second electron transport material are compounds represented by the following structural formulas (A1) and (A2):

(A1)

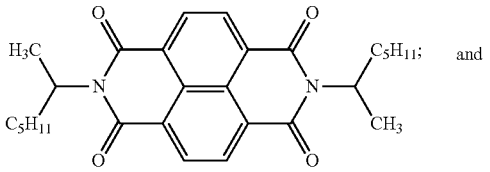

(A2)

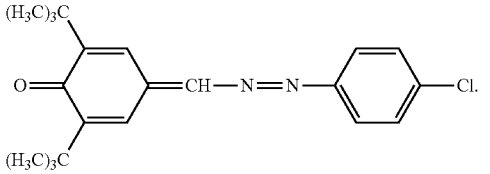

The inorganic oxide filler has a primary particle size of suitably from 1 nm to 300 nm.

The photosensitive layer may consist of a single layer containing the charge generation material, the hole transport material, the first electron transport material, the second electron transport material, the resin binder, and the inorganic oxide filler. In this case, it is preferable that a content F (% by mass) of the inorganic oxide filler is smaller than a combined content E (% by mass) of the first electron transport material and the second electron transport material in the solid content of the photosensitive layer, and the content F satisfies a relationship of $2 \leq F \leq 15$.

The photosensitive layer may also include a charge transport layer and a charge generation layer layered in that order on the conductive substrate, and the charge generation layer contains the charge generation material, the hole transport material, the first electron transport material, the second electron transport material, the resin binder, and the inorganic oxide filler. In this case, it is preferable that the content F (% by mass) of the inorganic oxide filler is smaller than the combined content E (% by mass) of the first electron transport material and the second electron transport material in the solid content of the charge generation layer, and the content F satisfies a relationship of $2 \leq F \leq 15$. In addition, it is also preferable that the combined content E (% by mass) of the first electron transport material and the second electron transport material is larger than a content H (% by mass) of the hole transport material in the solid content of the charge generation layer, and the combined content E and the content H satisfy $1.5 \leq E/H \leq 10.0$.

A second aspect of the present invention is a method of manufacturing an electrophotographic photoconductor, including providing a coating solution containing the charge generation material, the hole transport material, the first electron transport material, the second electron transport material, the resin binder, and the inorganic oxide filler surface-treated with a silane coupling agent; dip coating the conductive substrate into the coating solution to provide a coating; and drying the coating to forming the photosensitive layer.

A third aspect of the present invention is an electrophotographic device, including the electrophotographic photoconductor described above.

Effects of the Invention

According to the above-described aspects of the present invention, it was revealed that the amount of abrasion in the photosensitive layer can be reduced while maintaining the electrophotographic characteristics of the photoconductor with a specific combination of materials, thereby making it possible to suppress ghosting, to obtain favorable images stably for a long period of time, and to improve mechanical strength. It is thought that this is because a specific combination of two types of electron transport materials, a resin binder, and a filler surface-treated with a silane coupling agent is compounded into a photosensitive layer on the surface of a photoconductor such that the filler is sufficiently dispersed in the photosensitive layer, the durability of the photosensitive layer against abrasion is improved, and the light transmittance of the layer is improved so that the scattering of exposure light is prevented.

DETAILED DESCRIPTION OF THE INVENTION

Hereinafter, specific embodiments of the electrophotographic photoconductor of the present invention will be described in detail with reference to the drawings. The present invention is not limited at all by the following description.

Figure 1:
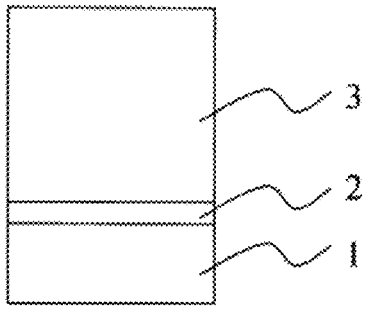
FIG. 1 is a schematic sectional view illustrating an example of a positively charged single-layered electrophotographic photoconductor of the present invention.

FIG. 1 is a schematic sectional view illustrating one example of an electrophotographic photoconductor of the present invention, depicting a positively charged single-layered photoconductor. As illustrated in the figure, an undercoat layer 2 and a single-layered photosensitive layer 3 having a function of generating charges and a function of transporting charges are layered in that order on a conductive substrate 1 in a positively charged single-layered photoconductor. The undercoat layer 2 may be provided as needed.

Figure 2:
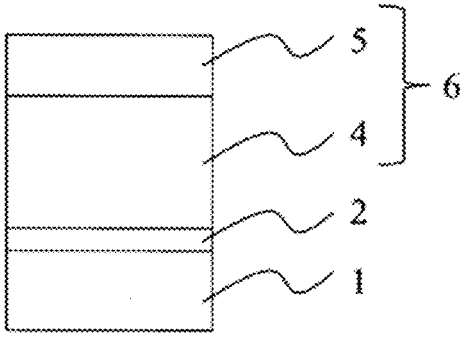
FIG. 2 is a schematic sectional view illustrating an example of a positively charged multi-layered electrophotographic photoconductor of the present invention.

FIG. 2 is a schematic sectional view illustrating another example of the electrophotographic photoconductor of the present invention, depicting a positively charged multi-layered photoconductor. As illustrated in the figure, a positively charged multi-layered photoconductor includes a multi-layered photosensitive layer 6. The multi-layered photosensitive layer 6 consists of a charge transport layer 4 having a function of transporting charges and a charge generation layer 5 having a function of generating charges which are layered in that order via an undercoat layer 2 on a conductive substrate 1. The undercoat layer 2 may be provided as needed.

The conductive substrate 1 serves not only as an electrode of the photoconductor but also as a support for each layer constituting the photoconductor, and may have any shape such as a cylindrical shape, a plate shape, and a film shape. Examples of a material of the conductive substrate 1 include metals such as aluminum, stainless steel, and nickel, and materials obtained by performing a conductive treatment on the surface of glass, resin, and the like.

The undercoat layer 2 is made of a layer mainly composed of a resin or a metal oxide film such as alumite, and may have a layered structure of an alumite layer and a resin layer. The undercoat layer 2 is provided as necessary for the purpose of controlling charge injection from the conductive substrate 1 to the photosensitive layer, covering defects on the surface of the conductive substrate 1, and improving the adhesiveness between the photosensitive layer and the conductive substrate 1. Examples of a resin material used for the undercoat layer 2 include insulating polymers such as casein, polyvinyl alcohol, polyamide, melamine, and cellulose, and conductive polymers such as polythiophene, polypyrrole, and polyaniline, which may be used singly or in combination as appropriate. Further, these resins may contain a metal oxide such as titanium dioxide or zinc oxide when used.

Positively Charged Single-Layered Photoconductor

In the positively charged single-layered photoconductor, the single-layered photosensitive layer 3 is a photosensitive layer formed on the undercoat layer 2. The single-layered photosensitive layer 3 is a single-layered positively charged photosensitive layer which is a single layer mainly containing a charge generation material, a hole transport material, and an electron transport material and resin binder. The photosensitive layer 3 further contains an inorganic oxide filler surface-treated with a silane coupling agent.

Examples of a charge generation material include X-type metal-free phthalocyanine, α-type titanyl phthalocyanine, β-type titanyl phthalocyanine, Y-type titanyl phthalocyanine, γ-type titanyl phthalocyanine, and amorphous-type titanyl phthalocyanine, which may be used singly or in combination as appropriate. A suitable substance can be selected according to the light wavelength range of an exposure light source used for image formation. From the viewpoint of increasing the sensitivity, titanyl phthalocyanine having high quantum efficiency is optimal.

Examples of a hole transport material include various hydrazone compounds, styryl compounds, diamine compounds, butadiene compounds, indole compounds, and the like, which may be used singly or in combination as appropriate. However, a styryl compound having a triphenylamine skeleton is suitable in terms of cost and performance.

An electron transport material includes first and second electron transport materials. The first and second electron transport materials may be selected from the group consisting of, for example, succinic anhydride, maleic anhydride, dibromo succinic anhydride, phthalic anhydride, 3-nitrophthalic anhydride, 4-nitrophthalic anhydride, pyromellitic anhydride, pyromellitic acid, trimellitic acid, trimellitic anhydride, phthalimide, 4-nitrophthalimide, tetracyanoethylene, tetracyanoquinodimethane, chloranil, bromanil, o-nitrobenzoic acid, malononitrile, trinitrofluorenone, trinitrothioxanthone, dinitrobenzene, dinitroanthracene, dinitroacridine, nitroanthraquinone, dinitroanthraquinone, thiopyran compounds, quinone compounds, benzoquinone compounds, diphenoquinone compounds, naphthoquinone compounds, anthraquinone compounds, stilbenequinone compounds, azoquinone compounds, naphthalenetetracarboxylic diimide compounds, and the like.

The first electron transport material and the second electron transport material are preferably selected from an azoquinone compound represented by general formula (ET1) below and a naphthalenetetracarboxylic diimide compound represented by general formula (ET2) below. Further, a naphthalenetetracarboxylic diimide compound represented by general formula (ET2) below is preferable as a first electron transport material, and an azoquinone compound represented by general formula (ET1) below is preferable as a second electron transport material. A naphthalenetetracarboxylic diimide compound contributes to potential stability in environmental changes. An azoquinone compound contributes to suppression of ghost images.

(ET1)

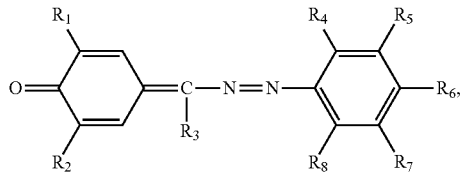

where $R_1$ and $R_2$ are the same or different and each represent a hydrogen atom, an alkyl group having 1 to 12 carbon atoms, an alkoxy group having 1 to 12 carbon atoms, an aryl group which may have a substituent, a cycloalkyl group, an aralkyl group which may have a substituent, or an alkyl halide group, $R_3$ represents a hydrogen atom, an alkyl group having 1 to 6 carbon atoms, an alkoxy group having 1 to 6 carbon atoms, an aryl group which may have a substituent, a cycloalkyl group, an aralkyl group which may have a substituent, or an alkyl halide group, $R_4$ to $R_8$ are the same or different and each represent a hydrogen atom, a halogen atom, an alkyl group having 1 to 12 carbon atoms, an alkoxy group having 1 to 12 carbon atoms, an aryl group which may have a substituent, an aralkyl group which may have a substituent, a phenoxy group which may have a substituent, an alkyl halide group, a cyano group, or a nitro group with a condition that two or more groups may be combined to form a ring, and each substituent represents a halogen atom, an alkyl group having 1 to 6 carbon atoms, an alkoxy group having 1 to 6 carbon atoms, a hydroxyl group, a cyano group, an amino group, a nitro group, or an alkyl halide group.

(ET2)

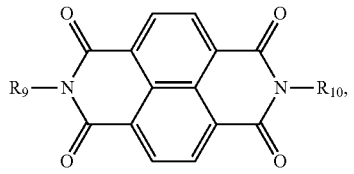

where $R_9$ and $R_{10}$ are the same or different and each represent a hydrogen atom, a halogen atom, a cyano group, a nitro group, a hydroxyl group, an alkyl group having 1 to 12 carbon atoms, an alkoxy group having 1 to 12 carbon atoms, an aryl group which may have a substituent, a heterocyclic group which may have a substituent, an ester group, a cycloalkyl group, an aralkyl group which may have a substituent, an allyl group, an amide group, an amino group, an acyl group, an alkenyl group, an alkynyl group, a carboxyl group, a carbonyl group, a carboxylic acid group, or an alkyl halide group, and each substituent represents a halogen atom, an alkyl group having 1 to 6 carbon atoms, an alkoxy group having 1 to 6 carbon atoms, a hydroxyl group, a cyano group, an amino group, a nitro group, or an alkyl halide group.

Specific examples of an electron transport material such as a naphthalenetetracarboxylic diimide compound or an azoquinone compound are represented by, for example, structural formulas A1 to A18 below. Suitable examples of the first electron transport material and the second electron transport material include a combination of a compound selected from the group consisting of compounds represented by structural formulas A1, A12, A13, A14, and A15 and a compound selected from the group consisting of compounds represented by structural formulas A2 and A11. In addition, it is also preferable that the first electron transport material and the second electron transport material are a combination of compounds represented by structural formulas (A1) and (A2).

A1

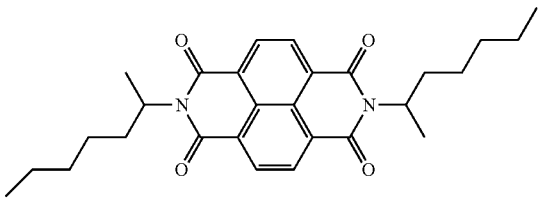

A2

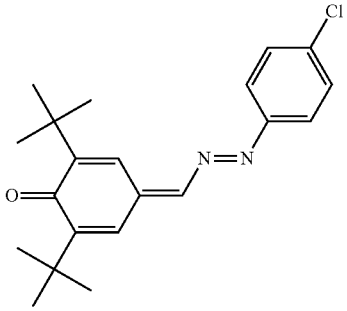

A3

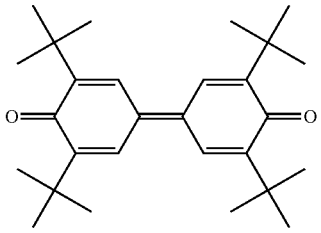

-continued

A4

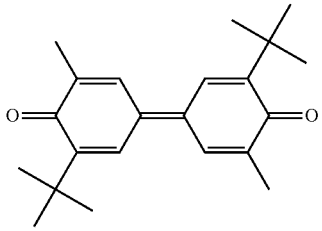

A5

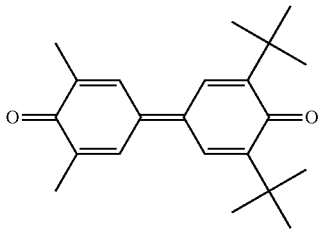

A6

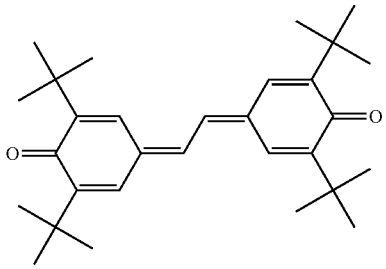

A7

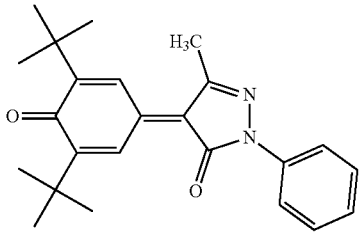

A8

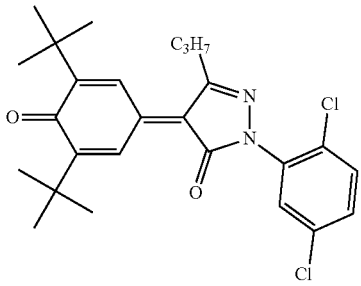

A9

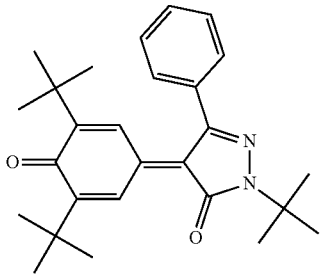

-continued

A10

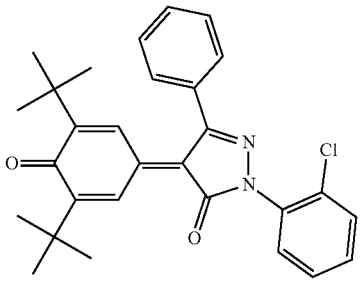

A11

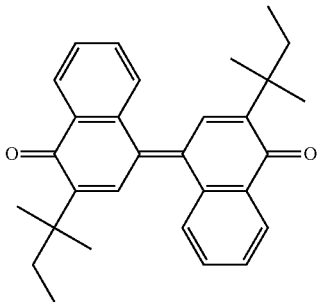

A12

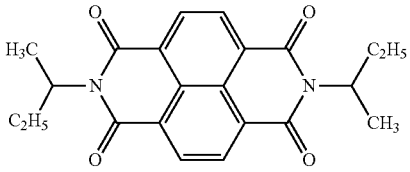

A13

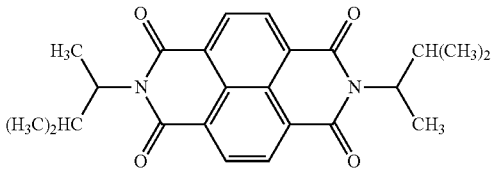

A14

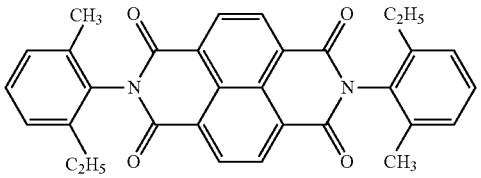

-continued

A15

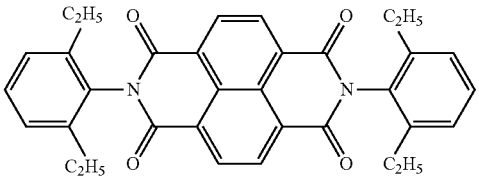

A16

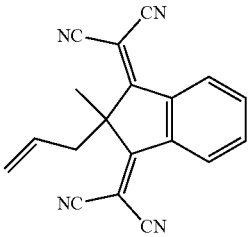

A17

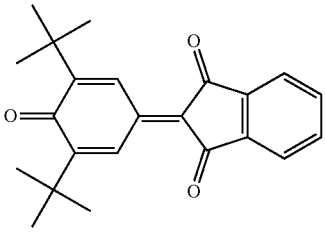

A18

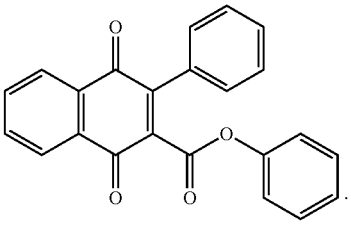

Examples of a resin binder that can be used for the single-layered photosensitive layer 3 include polycarbonate resins such as bisphenol A, bisphenol Z, bisphenol A-biphenyl copolymer, and bisphenol Z-biphenyl copolymer, polyphenylene resin, polyester resin, polyvinyl acetal resin, polyvinyl butyral resin, polyvinyl alcohol resin, vinyl chloride resin, vinyl acetate resin, polyethylene resin, polypropylene resin, acrylic resin, polyurethane resin, epoxy resin, melamine resin, silicone resin, polyamide resin, polystyrene resin, polyacetal resin, polyarylate resin, polysulfone resin, methacrylate polymer, and copolymers thereof. Further, resins of the same type having different molecular weights may be used in combination.

Specific examples of a preferable resin binder include polycarbonate resins having repeating units, such as bisphenol Z and bisphenol Z-biphenyl copolymer, represented by the following structural formulas (B1) to (B4).

B1

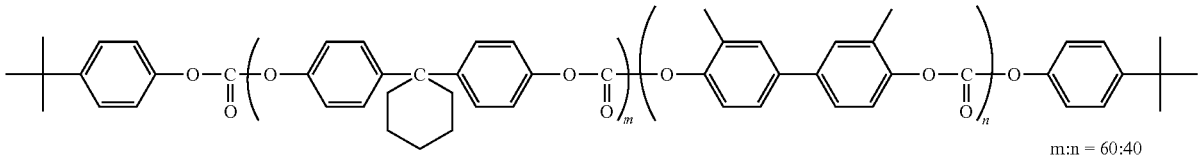

m:n = 60:40

B2

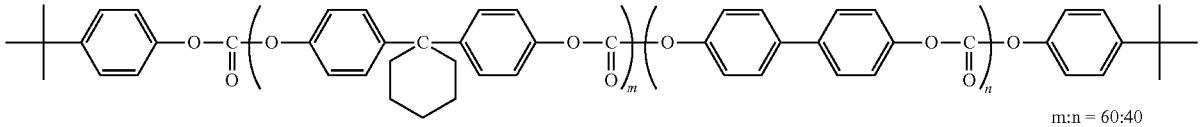

m:n = 60:40

B3

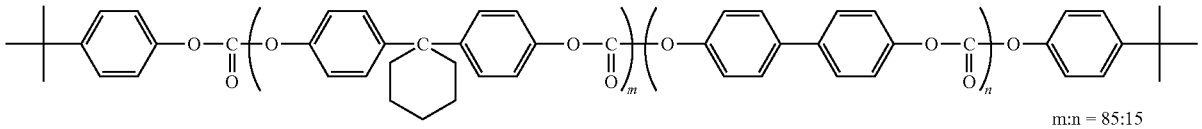

m:n = 85:15

B4

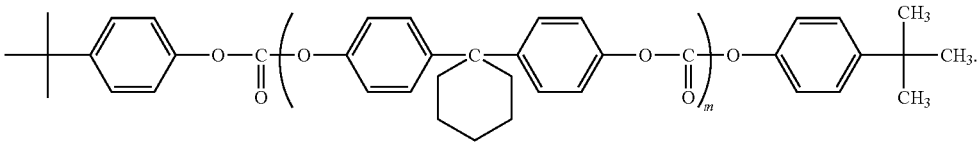

The weight average molecular weight of a resin binder is preferably from 5,000 to 250,000, more preferably from 10,000 to 200,000 in GPC (gel permeation chromatography) analysis in terms of polystyrene.

The inorganic oxide filler surface treated with a silane coupling agent is a material in which a silane coupling agent is attached to the surface of an inorganic oxide filler.

Examples of the inorganic oxide filler include fine particles mainly composed of silica as well as fine particles mainly composed of alumina, zirconia, titanium oxide, tin oxide, zinc oxide, or the like. These fine particles may have a hydroxyl group on the surface thereof when used, and when the fine particles are directly mixed into a coating liquid, the fine particles tend to aggregate with each other.

The primary particle size of the inorganic oxide filler is in a range of preferably from 1 nm to 300 nm, more preferably from 5 nm to 100 nm, still more preferably from 10 nm to 50 nm. When the primary particle size of the inorganic oxide filler is less than 1 nm, the dispersion state may be uneven due to aggregation. On the other hand, when the primary particle size of the inorganic oxide filler exceeds 300 nm, light scattering may increase and image loss may occur. The primary particle size is a number average diameter measured using a scanning microscope capable of directly observing the surface shape of particles.

Fine particles containing silica as a main component are preferable as the inorganic oxide filler. As a method of producing silica fine particles, a method of producing water glass as a raw material, which is called a wet method, a method of reacting chlorosilane or the like in a gas phase, which is called a dry method, a method of using an alkoxide, i.e., a silica precursor as a raw material, and the like have been known. Examples of such silica fine particles include YA010C manufactured by Admatechs Company Limited.

Surface treatment of the inorganic oxide filler with a silane coupling agent causes hydroxyl groups on the surface of the inorganic oxide filler and the silane coupling agent to bind to each other, thereby reducing cohesiveness between inorganic oxide filler particles.

Specific examples of the silane coupling agent include compounds represented by the following structural formulas C1 to C5:

C1

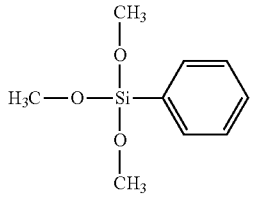

C2

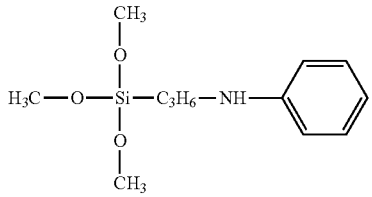

C3

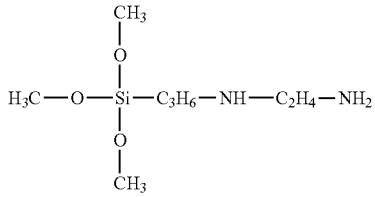

-continued

C4

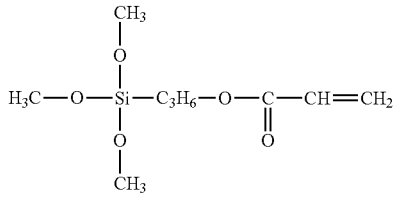

C5

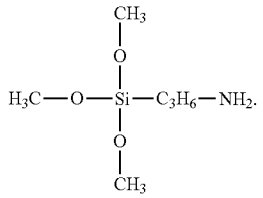

In a case in which a large amount of a dissimilar metal is present as an impurity in the inorganic oxide filler, defects caused by the metal at sites different from the sites of an ordinary oxide result in fluctuations in the charge distribution on the surface, which improves the cohesiveness of the filler starting from those sites and eventually causes an increase in aggregates in the coating liquid and the photosensitive layer during surface treatment. It is therefore preferable that the filler has high purity. It is preferable that the content of a metal other than the metal elements constituting the filler is controlled to 1000 ppm or less for each metal.

Meanwhile, in order to sufficiently react a surface-treating agent to improve the activity on the silica surface, it is preferable to add a very small amount of a different metal. The surface-treating agent reacts with a hydroxyl group present on the surface of silica. However, in a case in which silica contains a trace amount of a different metal, reactivity of a silanol group (hydroxyl group) adjacent to the different metal present on the silica surface is improved due to the influence of the difference in electronegativity between metals. Since this hydroxyl group has high reactivity with the surface-treating agent, it reacts with the surface-treating agent more strongly than other hydroxyl groups, and when remaining, it causes aggregation. After the reaction with the surface-treating agent, the surface-treating agent reacts with other hydroxyl groups, and due to the effects of the surface-treating agent and the effects of reducing the bias of the surface charge due to the dissimilar metal on the surface, the cohesiveness between silica particles is expected to be greatly improved. In an embodiment of the present invention, in a case in which the inorganic oxide contains a trace amount of a different metal, the reactivity of the surface-treating agent becomes more favorable, and as a result, the dispersibility is improved due to surface treatment, which is preferable. It can be said that the improvement in the cohesiveness when the above-described dissimilar metal is present in a large amount as an impurity and the improvement in the dispersibility by including a very small amount of a different metal are based on different mechanisms.

Regarding silica, the addition of aluminum in a range of 1000 ppm or less is preferable for surface treatment. The amount of aluminum in silica can be adjusted using a method described in JP2004-143028A, JP2013-224225A, or the like. The adjustment method is not particularly limited as long as the amount can be controlled in a desired range. Specifically, as a method of more preferably controlling the amount of aluminum on the silica surface, for example, the following method is available. There is a method in which first, when producing silica fine particles, after growing the silica particles in a shape smaller than the target silica particle size, the amount of aluminum on the silica surface is controlled by, for example, adding aluminum alkoxide serving as an aluminum source. There are also an method in which silica fine particles are put in a solution containing aluminum chloride to coat the surfaces of silica fine particles with the aluminum chloride solution, and the particles are dried to and fired, a method in which a mixed gas of an aluminum halide compound and a silicon halide compound is reacted, and the like.

In addition, it is known that the structure of silica is such that a plurality of silicon atoms and oxygen atoms are connected cyclically to form a network-like bonding structure. When aluminum is contained, the number of atoms constituting the cyclic structure of silica becomes larger than that of ordinary silica due to the effect of mixing aluminum. Due to this effect, steric hindrance present when the surface treatment agent reacts with the hydroxyl group on the aluminum-containing silica surface is reduced as compared to the ordinary silica surface, and the reactivity of the surface-treating agent is improved, resulting in surface-treated silica having improved dispersibility as compared to when the same surface treatment agent is reacted with ordinary silica.

Here, in order to maintain the effects of the embodiment of the present invention, silica obtained by a wet method is more preferable for controlling the amount of aluminum. Further, the content of aluminum with respect to silica is preferably 1 ppm or more in consideration of the reactivity of the surface-treating agent.

The form of the inorganic oxide is not particularly limited. However, in order to reduce cohesiveness and achieve a uniform dispersion state, the sphericity of the organic oxide is preferably 0.8 or more, more preferably 0.9 or more.

When using an organic oxide for a charge transport layer of a photoconductor where high resolution is expected, it is preferable to consider the effects of α-rays derived from a material added to the charge transport layer. For example, taking a semiconductor memory element as an example, the memory element holds the type of data to be stored depending on whether or not electric charges are stored, while on the other hand, the size of the stored charges also decreases with miniaturization, and the type of data changes due to charges that would vary with α-rays emitted from the outside, resulting in unexpected changes in data. Further, since the magnitude of the current flowing through the semiconductor element also becomes small, the current (noise) generated by α-rays becomes relatively large as compared with the magnitude of the signal, which may cause malfunction. Considering the influence on the movement of charges in the charge transport layer of the photoconductor in the same manner as the above phenomenon, it is more preferable to use a material that generates less α-rays as a material constituting a film. Specifically, it is effective to reduce the concentrations of uranium and thorium in an organic oxide. Preferably, the concentration of thorium is 30 ppb or less and the concentration of uranium is 1 ppb or less. A method of reducing the amounts of uranium and thorium in an inorganic oxide is described in, for example, JP2013-224225A. However, the method is not limited as long as the concentrations of these elements can be reduced.

A combination of an electron transport material, a resin binder, and a silane coupling agent used for a single-layered photosensitive layer 3 preferably satisfies a specific relationship with respect to Hansen solubility parameters. A difference ΔSPa in a dipole-dipole force component that is a Hansen solubility parameter between a first electron transport material and a silane coupling agent satisfies a relationship of ΔSPa<2.50. A difference ΔSPb in a dipole-dipole force component that is a Hansen solubility parameter between a second electron transport material and a silane coupling agent satisfies a relationship of ΔSPb<2.50. A difference ΔSPc in a dipole-dipole force component that is a Hansen solubility parameter between a first electron transport material and a second electron transport material satisfies a relationship of 0.30<ΔSPc<1.00. Further, a difference ΔSPd in a London dispersion force component that is a Hansen solubility parameter between a resin binder and a silane coupling agent satisfies a relationship of ΔSPd<2.00.

By selecting materials satisfying such relationships, compatibility among the electron transport material, the resin binder, and the silane coupling agent, and in particular, sufficient compatibility between the first electron transport material and the second electron transport material can be achieved in the single-layered photosensitive layer 3, allowing dispersibility of the inorganic oxide filler to be improved. The high dispersibility also makes it possible to sufficiently reduce the abrasion amount on the surface of the photoconductor, and at the same time, to ensure favorable electrical characteristics and image characteristics.

Regarding the Hansen solubility parameter of the silane coupling agent, ΔSPa and ΔSPb are preferably ΔSPa≤2.40 and ΔSPb≤2.40, and ΔSPd is ΔSPd<1.90. The smaller they are, the more preferable they are.

Regarding the Hansen solubility parameters of the first electron transport material and the second electron transport material, ΔSPc is in a range of 0.30<ΔSPc<1.00, preferably 0.30<ΔSPc<0.80, still more preferably 0.30<ΔSPc<0.60. When ΔSPc is 0.30 or less, great compatibility between the first electron transport material and the second electron transport material makes it impossible to obtain sufficient effects in terms of filler dispersibility even selecting a silane coupling agent that satisfies ΔSPa and ΔSPb. When ΔSPc is 1.00 or more, compatibility between two types of electron transport materials is insufficient, resulting in a decrease in dispersibility at the molecular level and formation of charge traps. Thus, ghost reduction effects cannot be obtained sufficiently. In the case of ΔSPc<0.60, excellent ghost reduction effects can be obtained.

The content of each material relative to the solid content of the single-layered photosensitive layer 3 is as follows. The content of a charge generation material is preferably from 0.1% to 5% by mass, more preferably from 0.5% to 3% by mass. The content of a hole transport material is preferably from 3% to 60% by mass, more preferably from 10% to 40% by mass. The content of an electron transport material is preferably from 1% to 50% by mass, more preferably from 5% to 20% by mass. The content of an inorganic oxide filler surface-treated with a silane coupling agent is preferably from 2% to 15% by mass. The content of a resin binder is preferably from 20% to 80% by mass, more preferably from 30% to 70% by mass. The content of a resin binder may be preferably from 20% to 90% by mass, more preferably from 30% to 80% by mass relative to the solid content of the photosensitive layer 3 excluding an inorganic oxide filler.

The ratio of the contents of the electron transport material and the hole transport material may be in a range of from 1:1 to 1:4, preferably in a range of from 1:1 to 1:3. From the viewpoint of the transport balance between holes and electrons, a ratio in this range is preferable in sensitivity characteristics, charging characteristics, and fatigue characteristics. The ratio of the content of the second electron transport material to the content of the first electron transport material and the second electron transport material is desirably in a range of from 3% by mass to 40% by mass. When the content of the second electron transport material is not in a range of from 3% by mass to 40% by mass, the improvement of electron injectability becomes insufficient, and ghost suppression effects cannot be sufficiently obtained.

In addition, regarding the solid content of the single-layered photosensitive layer 3, when the content of the inorganic oxide filler is F (% by mass) and the content of the first electron transport material and the second electron transport material is E (% by mass), the content F is preferably smaller than the combined content E. When the content F is equal to or larger than the combined content E, the improvement of electron injectability of the electron transport material becomes insufficient, and the effect of suppressing ghost may not be obtained.

Further, the ratio of the content E2 (% by mass) of the second electron transport material to the content F (% by mass) of the inorganic oxide filler is preferably in a range of from 1/15 to 20. When the amount is other than this ratio, the electron injectability becomes insufficient, and the effect of suppressing ghost may not be obtained.

The film thickness of the single-layered photosensitive layer 3 is preferably in a range of from 12 to 40 μm, more preferably from 15 to 35 μm, and still more preferably from 20 to 30 μm from the viewpoint of ensuring practically effective performance.

The single-layered photosensitive layer 3 may contain a deterioration inhibitor such as an antioxidant or a light stabilizer for the purpose of improving environmental resistance and stability against harmful light, if desired. Examples of a compound used for such purpose include chromanol derivatives such as tocopherol, esterified compounds, polyarylalkane compounds, hydroquinone derivatives, etherified compounds, dietherified compounds, benzophenone derivatives, benzotriazole derivatives, thioether compounds, phenylenediamine derivatives, phosphonates, phosphites, phenol compounds, hindered phenol compounds, linear amine compounds, cyclic amine compounds, hindered amine compounds, and the like.

The single-layered photosensitive layer 3 may contain a leveling agent such as silicone oil or fluorine-based oil for the purpose of improving the leveling property of a formed film and imparting lubricity. In addition to the inorganic oxide filler surface-treated with a silane coupling agent, fine particles of metal oxide such as calcium oxide, metal sulfates such as barium sulfate and calcium sulfate, fine particles of metal nitride such as silicon nitride or aluminum nitride or particles of fluorine resin such as tetrafluoroethylene resin, fluorine-based comb-type graft polymer resin, or the like may be further contained for the purpose of adjusting the film hardness, reducing the coefficient of friction, imparting lubricity, or the like. Furthermore, if necessary, other known additives can be contained within a range that does not significantly impair electrophotographic properties.

Positively Charged Multi-Layered Photoconductor

In the case of a positively charged multi-layered photoconductor, a multi-layered photosensitive layer 6 includes a charge transport layer 4 and a charge generation layer 5. The charge transport layer 4 and the charge generation layer 5 are layered in that order on a conductive substrate 1. In the positively charged multi-layered photoconductor, the charge transport layer 4 contains a hole transport material and resin binder, the charge generation layer 5 contains a charge generation material, a hole transport material, a first electron transport material, a second electron transport material, an inorganic oxide filler surface-treated with a silane coupling agent, and resin binder. A undercoat layer 2 may be provided between the conductive substrate 1 and the charge transport layer 4.

As the hole transport material and the resin binder in the charge transport layer 4, the same materials as those described for the single-layered photosensitive layer 3 can be used. The content of the hole transport material in the charge transport layer 4 is preferably from 10% to 80% by mass, more preferably from 20% to 70% by mass relative to the solid content of the charge transport layer 4. The content of the resin binder in the charge transport layer 4 is preferably from 20% to 90% by mass, more preferably from 30% to 80% by mass relative to the solid content of the charge transport layer 4. The film thickness of the charge transport layer 4 is preferably in a range of from 3 to 50 μm, and more preferably in a range of from 15 to 40 μm in order to maintain a practically effective surface potential.

As the charge generation material, the hole transport material, first electron transport material, the second electron transport material, the inorganic oxide filler surface-treated with a silane coupling agent, and the resin binder in the charge generation layer 5, the same materials as those described for the single-layered photosensitive layer 3 can be used.

In the case of a positively charged multi-layered photoconductor, a combination of an electron transport material, a resin binder, and a silane coupling agent used for a charge generation layer 5 preferably satisfies a specific relationship the same as that for a single-layered photosensitive layer 3 with respect to the Hansen solubility parameter.

The content of each material relative to the solid content of the charge generation layer 5 is as follows. The content of a charge generation material is preferably from 0.1% to 5% by mass, more preferably from 0.5% to 3% by mass. The content of a hole transport material is preferably from 1% to 30% by mass, more preferably from 5% to 20% by mass. The content of an electron transport material is preferably from 5% to 60% by mass, more preferably from 10% to 40% by mass. The content of an inorganic oxide filler surface-treated with a silane coupling agent is preferably from 2% to 15% by mass. The content of a resin binder is preferably from 20% to 80% by mass, more preferably from 30% to 70% by mass.

The ratio of the content of the second electron transport material to the content of the first electron transport material and the second electron transport material is desirably in a range of from 3% by mass to 40% by mass.

Regarding the solid content of the charge generation layer 5, when the content of the inorganic oxide filler is F (% by mass), the combined content of the first electron transport material and the second electron transport material is E (% by mass), and the content of the hole transport material is H (% by mass), the content F is preferably smaller than the combined content E, and the combined content E is preferably greater than the content H (% by mass). Further, the ratio of the content E2 (% by mass) of the second electron transport material to the content F (% by mass) of the inorganic oxide filler is preferably in a range of from 1/15 to 20.

By controlling the contents within these ranges, electron injectability is improved, and the balance of the charge transfer with the hole transport material is also improved, so that the effect of suppressing ghost is more effectively obtained.

The ratio of the combined content E (% by mass) of the electron transport material to the content H (% by mass) of the hole transport material is preferably $1.5 \leq E/H \leq 10.0$, which means that H:E may be in a range of from 1:1.5 to 1:10, more preferably from 1:2 to 1:10. An electron transport material includes first and second electron transport materials. Even when the content of the electron transport material relative to the hole transport material is large, it is possible to suppress crystallization in the photosensitive layer using the above-described first and second electron transport materials, thereby sufficiently dispersing the filler.

The film thickness of the charge generation layer 5 can be the same as that of the single-layered photosensitive layer 3 of the single-layered photoconductor. The film thickness is preferably in a range of from 3 to 100 μm, more preferably in a range of from 5 to 40 μm.

Further, as with the single-layered photosensitive layer 3, the multi-layered photosensitive layer 6 can contain a deterioration inhibitor such as an antioxidant or a light stabilizer, a leveling agent, and the like, if desired.

Method of Manufacturing Photoconductor

A method of manufacturing a photoconductor according to the embodiment of the present invention includes a step of forming a photosensitive layer using a dip coating method when manufacturing the above-described electrophotographic photoconductor.

Figure 6:
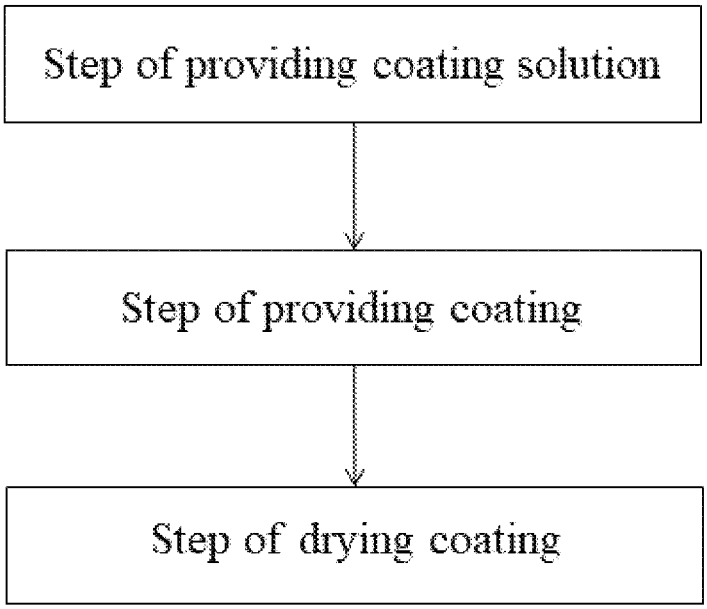
FIG. 6 is a flow chart of the method of manufacturing an electrophotographic photoconductor of the present invention.

The method of manufacturing a single-layered photoconductor is illustrated in FIG. 6 and includes: a step of dissolving and dispersing a charge generation material, a hole transport material, a first electron transport material, a second electron transport material, a resin binder, and an inorganic oxide filler surface-treated with a silane coupling agent as described above in a solvent to prepare a coating liquid; a step of applying the coating liquid to the outer periphery of a conductive substrate by a dip coating method via an undercoat layer as required; and a step of drying the coating liquid to form a photosensitive layer.

The method of manufacturing a multi-layered photoconductor includes a step of forming a charge transport layer on a conductive substrate and a step of forming a charge generation layer. The step of forming a charge transport layer includes: dissolving an arbitrary hole transport material and a resin binder in a solvent to prepare a coating liquid for forming a charge transport layer; and a step of applying the coating liquid to the outer periphery of a conductive substrate by a dip coating method via an undercoat layer as required; and a step of drying the coating liquid. Next, the sequence of steps in FIG. 6 is repeated and includes the step of forming a charge generation layer includes: a step of dissolving and dispersing a charge generation material, an electron transport material, a hole transport material, a resin binder, and an inorganic oxide filler surface-treated with a silane coupling agent in a solvent to prepare a coating liquid for forming a charge generation layer; a step of applying the coating liquid to the above-described charge transport layer by a dip coating method; and a step of drying the coating liquid to form a charge generation layer. A multi-layered photoconductor of the embodiment can be manufactured by the above described method.

The step of preparing a coating liquid containing an inorganic oxide filler surface-treated with a silane coupling agent may include: a step of dispersing a charge generation material and the like in a solvent to prepare a coating liquid A; and a step of dispersing the inorganic oxide filler surface-treated with a silane coupling agent in the coating liquid A to prepare a coating liquid B.

Examples of a solvent used for forming a photosensitive layer can include: halogenated hydrocarbons such as dichloromethane, dichloroethane, chloroform, carbon tetrachloride, and chlorobenzene; ethers such as dimethyl ether, diethyl ether, tetrahydrofuran, dioxane, dioxolane, ethylene glycol dimethyl ether, diethylene glycol dimethyl ether; and ketones such as acetone, methyl ethyl ketone, and cyclohexanone. Such a solvent can be appropriately selected from the viewpoints of solubility, liquid stability, and coating performance of various materials.

Here, the type of solvent used for preparing the coating liquid, coating conditions, drying conditions, and the like can also be appropriately selected according to an ordinary method, and are not particularly limited.

Electrophotographic Device

An electrophotographic device according to the embodiment of the present invention includes with the above-described photoconductor, and thus, expected effects can be obtained by applying the electrophotographic device to various machine processes. Specifically, sufficient effects can be obtained also in charging processes such as a contact charging method using a charging member such as a roller or brush and a non-contact charging method using a charging member such as corotron or scorotron and development processes such as a contact development method and a non-contact development method using non-magnetic one-component, magnetic one-component, two-component development methods (developers) and the like.

The electrophotographic device of the embodiment of the present invention includes the above-described electrophotographic photoconductor, and can be an electrophotographic device for tandem color printing at a printing speed of 20 ppm or more. Further, the electrophotographic device according to another embodiment of the present invention can be an electrophotographic device including the above-described electrophotographic photoconductor and having a printing speed of 40 ppm or more. It is considered that space charges easily accumulate in devices where photoconductors are heavily used, such as high-speed machines that require high charge transport performance in the photosensitive layer and tandem color machines that are greatly affected by discharge gas, especially those with short time between processes. In such an electrophotographic device, since ghost images are easily generated, the application of the present invention is more useful. In particular, in a tandem-type electrophotographic device for color printing or an electrophotographic device having no discharging member, ghost images are likely to occur, and therefore, the application of the present invention is useful.

Figure 3:
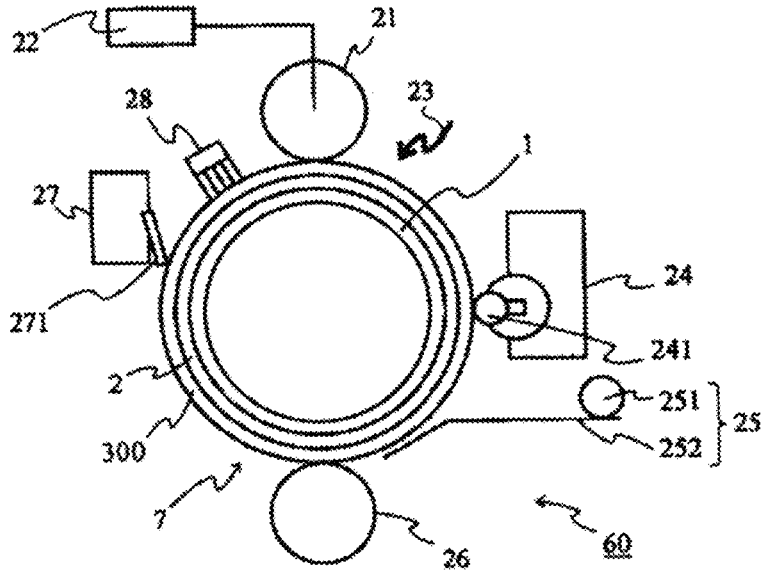
FIG. 3 is a schematic configuration diagram illustrating an example of the electrophotographic device of the present invention.

FIG. 3 is a schematic configuration diagram illustrating a configuration example of an electrophotographic device according to the embodiment of the present invention. The illustrated electrophotographic device 60 of the present invention includes a photoconductor 7 including a conductive substrate 1, an undercoat layer 2 formed on the outer peripheral surface thereof, and a photosensitive layer 300. Further, the electrophotographic device 60 includes at least a charging member and a developing unit. The electrophotographic device 60 may include a charging device, an exposure device, a developing device, a paper feeding device, a transfer device, and a cleaning device disposed on the outer peripheral edge of the photoconductor 7. In the illustrated example, the electrophotographic device 60 is composed of a charging member 21, a charging device including a high voltage power supply 22 that supplies a voltage to a charging member 21, an exposure device including an image exposure member 23, a developing unit 24 having a developing roller 241 serving as a developing device, a paper feeding member 25 having a paper feeding roller 251 and a paper feeding guide 252 serving as a paper feeding device, and a transfer device including a transfer charger (direct charging type) 26. The electrophotographic device 60 may further include a cleaning device 27 with a cleaning blade 271 and a discharging member 28. Further, the electrophotographic device 60 of the present invention can be a color printer.

Figure 4:
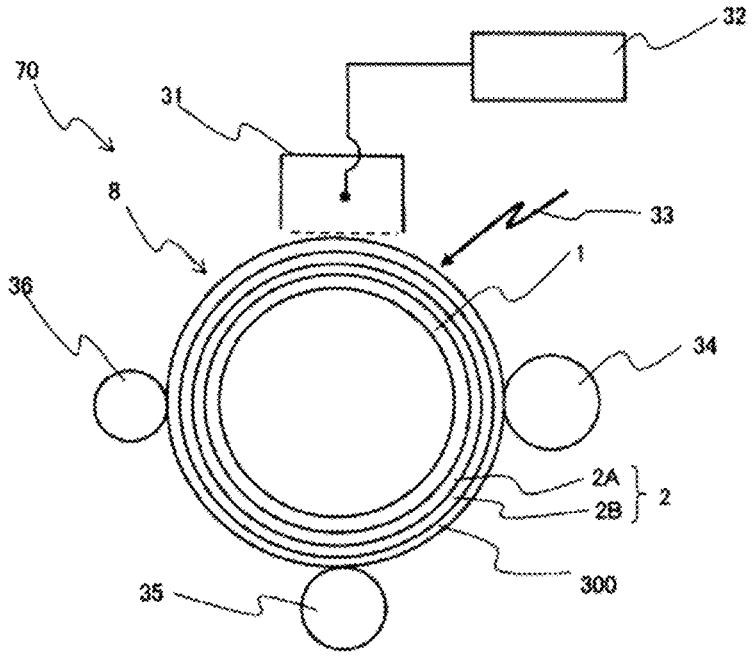
FIG. 4 is a schematic configuration diagram illustrating another example of the electrophotographic device of the present invention.

FIG. 4 is a schematic configuration diagram illustrating another configuration example of an electrophotographic device according to the embodiment of the present invention. The electrophotographic process in the illustrated electrophotographic device represents a monochrome high-speed printer. The illustrated electrophotographic device 70 is provided with a photoconductor 8 including a conductive substrate 1, an undercoat layer 2 covering the outer peripheral surface thereof, and a photosensitive layer 300. In the photoconductor 8 of this embodiment, the undercoat layer 2 has a layered structure of an alumite layer 2A and a resin layer 2B. The electrophotographic device 70 may also include a charging device disposed on the outer peripheral edge of a photoconductor 8, an exposure device, a developing device, a paper feeding device, a transfer device, and a cleaning device. In the illustrated example, the electrophotographic device 70 is composed of a charging member 31, a charging device including a power supply 32 that supplies an applied voltage to a charging member 31, an exposure device including an image exposure member 33, a developing device including a developing member 34, and a transfer device including a transfer member 35. The electrophotographic device 70 may further include a cleaning device including a cleaning member 36 and a paper feeding device.

EXAMPLES

Hereinafter, specific embodiments of the present invention will be described in more detail using the Examples. The present invention is not limited by the following Examples unless it exceeds the gist thereof.

Example of preparing positively charged single-layered photoconductor

Example 1

As a conductive substrate, a 0.75-mm thick aluminum tube cut to have a diameter φ of 30 mm× a length of 244.5 mm and a surface roughness (Rmax) of 0.2 μm was used. The conductive substrate had an alumite layer on the surface.

Single-Layered Photosensitive Layer

A single-layered photosensitive layer was formed according to the compounding amounts shown in Table 1 below. A coating liquid A was prepared by dissolving a compound represented by structural formula (HT1) below as a hole transport material, a compound represented by the structural formula (A1) described above as a first electron transport material, a compound represented by the structural formula (A2) described above as a second electron transport material, and a polycarbonate resin having a repeating unit represented by the structural formula (B1) described above as a resin binder in tetrahydrofuran, adding titanyl phthalocyanine represented by structural formula (CG1) below as a charge generation material, and performing dispersion treatment with a sand grind mill. As an inorganic oxide filler surface treated with a silane coupling agent, a surface-treated silica was prepared by surface-treating silica manufactured by Admatechs Company Limited (YA010C; aluminum content: 500 ppm) with a silane coupling agent represented by the structural formula (C1) described above. The surface-treated silica was mixed and dispersed in the coating liquid A to prepare a photosensitive layer coating liquid B in which the filler was dispersed. The coating liquid B was applied to the above-described conductive substrate by a dip coating method, and dried at a temperature of 100° C. for 60 minutes to form a single-layered photosensitive layer having a film thickness of about 25 μm, thereby obtaining a positively charged single-layered photoconductor.

(HT1)

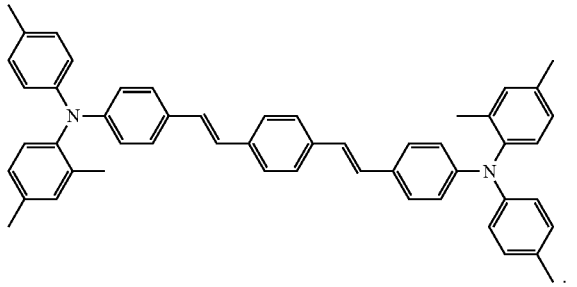

(CG1)

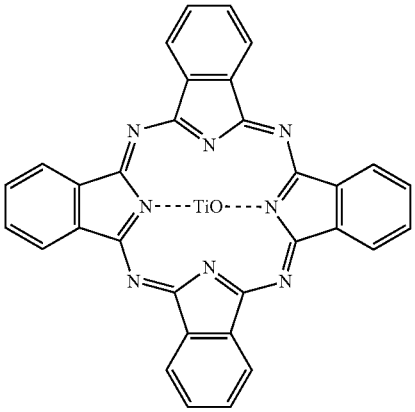

Examples 2 to 15 and Comparative Examples 1 to 9

A single-layered photosensitive layer was formed in the same manner as in Example 1 except that the type and amount of each material were changed according to the conditions shown in Table 1 below, thereby obtaining the positively charged single-layered photoconductors of Examples 2 to 15 and Comparative Examples 1 to 9. The structural formulas of the materials used in the Comparative Examples are shown below.

(C6)

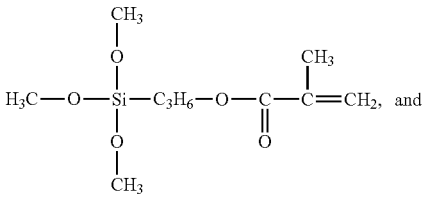

-continued (C7)

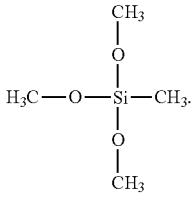

Example of preparing positively charged multi-layered photoconductor

Example 16

As a conductive substrate, a 0.75-mm thick aluminum tube cut to have a diameter φ of 30 mm× a length of 254.4 mm and a surface roughness (Rmax) of 0.2 μm was used. The conductive substrate had an alumite layer on the surface.

Charge Transport Layer

A coating liquid C was prepared by dissolving a compound represented by the structural formula (HT1) described above as a hole transport material and a polycarbonate resin having a repeating unit represented by the structural formula (B1) described above as a resin binder in tetrahydrofuran. The coating liquid C was applied to the above-described conductive substrate by a dip coating method, and dried at 100° C. for 30 minutes, thereby forming a charge transport layer having a film thickness of 10 μm. The contents of the hole transport material and the resin binder with respect to the solid content of the charge transport layer were each 50.0% by mass.

Charge Generation Layer

A charge generation layer was formed according to the compounding amounts shown in Table 2 below. A coating liquid D was prepared by dissolving a compound represented by the structural formula (HT1) described above as a hole transport material, a compound represented by the structural formula (A1) described above as a first electron transport material, a compound represented by the structural formula (A2) described above as a second electron transport material, and a polycarbonate resin having a repeating unit represented by the structural formula (B1) described above as a resin binder in tetrahydrofuran, adding titanyl phthalocyanine represented by the structural formula (CG1) described above as a charge generation substance, and performing dispersion treatment with a sand grind mill. As an inorganic oxide filler surface treated with a silane coupling agent, a surface-treated silica was prepared by surface-treating silica manufactured by Admatechs Company Limited (YA010C; aluminum content: 500 ppm) with a silane coupling agent represented by the structural formula (C1) described above. The surface-treated silica was mixed and dispersed in the coating liquid D to prepare a charge generation layer coating liquid E in which the surface-treated silica was dispersed. A coating liquid E was applied to the above-described charge transport layer by a dip coating method, and dried at a temperature of 110° C. for 30 minutes to form a charge generation layer having a film thickness of 15 μm, thereby obtaining a positively charged multi-layered photoconductor having a photosensitive layer having a film thickness of about 25 μm.

Examples 17 to 32 and Comparative Examples 10 to 20

A charge generation layer was formed in the same manner as in Example 16 except that the type and amount of each material were changed according to the conditions shown in Table 2 below, thereby obtaining the positively charged multi-layered photoconductors of Examples 17 to 32 and Comparative Examples 10 to 20.

Evaluation of Positively Charged Single-Layered Photoconductors

The single-layered photoconductors of Examples 1 to 15 and Comparative Examples 1 to 9 were each integrated into a commercially available printer HL5200DW manufactured by Brother Industries, Ltd. to evaluate each photoconductor under three environments of 10° C.-20% (LL, low temperature and low humidity), 25° C.-50% (NN, normal temperature and normal humidity), and 35° C.-85% (HH, High temperature and high humidity). The results are shown in Table 3 below.

Evaluation of Electrical Characteristics

The electrical characteristics of the photoconductor obtained in each of the Examples and Comparative Examples were evaluated by the following method using a process simulator (CYNTHIA91) manufactured by GEN-TEC. For the photoconductors of Examples 1 to 15 and Comparative Examples 1 to 9, the surface of each photoconductor was charged to +650 V by corona discharge in a dark place under the environment at a temperature of 22° C. and a humidity of 50%, and the surface potential V0 immediately after charging was measured. Subsequently, after leaving each photoconductor in a dark place for 5 seconds, the surface potential V5 was measured, and the potential retention rate Vk5(%) 5 seconds after charging was obtained according to the following calculation formula (1):

$$Vk5=V5/V0\times100 \quad (1).$$

Next, using a halogen lamp as a light source, each photoconductor was irradiated with exposure light of 1.0 $\mu W/cm^2$, which was dispersed at 780 nm using a filter, for 5 seconds after when the surface potential became +600 V, and the residual potential on the photoconductor surface 5 seconds after exposure was evaluated as Vr5 (V).

Evaluation of Abrasion Resistance

For the photoconductor obtained in each of the Examples and the Comparative Examples, 10,000 sheets of A4 paper were printed, the film thickness of the photosensitive layer before and after printing was measured, and the average abrasion amount (μm) after printing was evaluated. The average abrasion amount is a value obtained by measuring the film thickness at four points obtained by rotating the position of the center (130 mm from the end) of the photoconductor in the longitudinal direction by 90° in the circumferential direction and averaging the values.

Evaluation of Ghost Image

Figure 5:
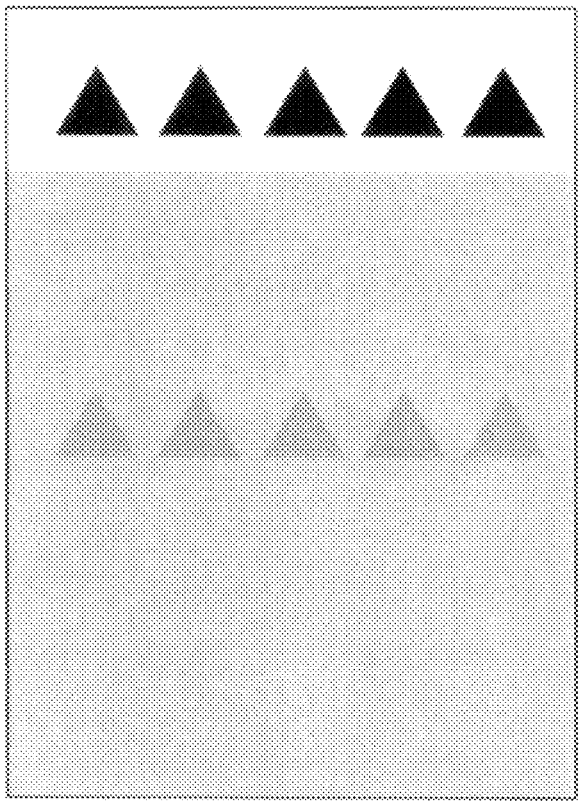
FIG. 5 is an explanatory diagram illustrating a halftone image.

The halftone (1on2off) image shown in FIG. 5 was printed in an HH environment, and the presence or absence of negative ghosting was evaluated. The results were evaluated as "◎" when no ghost was observed, "○" when ghost was slightly observed, "Δ" when ghost was observed, and "x" when ghost was clearly observed.

Evaluation of Environmental Stability of Print Density

A solid pattern of 25 mm×25 mm square was formed on A4 paper under three environments of LL, NN and HH, and the print density was measured using a Macbeth densitometer in each environment. The difference between the minimum and maximum values of print density in the three environments was calculated. The results were classified into "◎" with a print density of less than 0.1, "○" with a print density of from 0.1 to less than 0.2, "Δ" with a print density of from 0.2 to less than 0.4, or "x" with a print density of 0.4 or more.

Evaluation of Positively Charged Multi-Layered Photoconductor

The positively charged multi-layered photoconductors of Examples 16 to 32 and Comparative Examples 10 to 20 were each integrated into a commercially available printer HL3170CDW manufactured by Brother Industries, Ltd. to evaluate each photoconductor under three environments of 10° C.-20% (LL, low temperature and low humidity), 25° C.-50% (NN, normal temperature and normal humidity), and 35° C.-85% (HH, High temperature and high humidity). The results are shown in Table 4 below.

Evaluation of Electrical Characteristics

The electrical characteristics of the photoconductor obtained in each of the Examples and Comparative Examples were evaluated by the following methods using a process simulator (CYNTHIA91) manufactured by GEN-TEC. For the photoconductors of Examples 16 to 32 and Comparative Examples 10 to 20, the surface of each photoconductor was charged to +650 V by corona discharge in a dark place under the environment at a temperature of 22° C. and a humidity of 50%, and the surface potential V0 immediately after charging was measured. Subsequently, after leaving each photoconductor in a dark place for 5 seconds, the surface potential V5 was measured, and the potential retention rate Vk5(%) 5 seconds after charging was obtained according to the following calculation formula (1):

$$Vk5=V5/V0\times100 \quad (1).$$

Next, using a halogen lamp as a light source, each photoconductor was irradiated with exposure light of 1.0 $\mu W/cm^2$, which was dispersed at 780 nm using a filter, for 5 seconds after when the surface potential became +600 V, and the residual potential on the photoconductor surface 5 seconds after exposure was evaluated as Vr5 (V).

Evaluation of Abrasion Resistance

For the photoconductor obtained in each of the Examples and the Comparative Examples, 10,000 sheets of A4 paper were printed, the film thickness of the photosensitive layer before and after printing was measured, and the average abrasion amount (μm) after printing was evaluated. The average abrasion amount is a value obtained by measuring the film thickness at four points obtained by rotating the position of the center (130 mm from the end) of the photoconductor in the longitudinal direction by 90° in the circumferential direction and averaging the values.

Evaluation of Ghost Image

The halftone (1on2off) image shown in FIG. 5 was printed in an HH environment, and the presence or absence of negative ghosting was evaluated. The results were evaluated as "◎" when no ghost was observed, "○" when ghost was slightly observed, "Δ" when ghost was observed, and "x" when ghost was clearly observed.

Evaluation of Environmental Stability of Print Density

A solid pattern of 25 mm×25 mm square was formed on A4 paper under three environments of LL, NN and HH, and the print density was measured using a Macbeth densitometer in each environment. The difference between the minimum and maximum values of print density in the three environments was calculated. The results were classified into "◎" with a print density of less than 0.1, "○" with a print density of from 0.1 to less than 0.2, "Δ" with a print density of from 0.2 to less than 0.4, or "x" with a print density of 0.4 or more.

TABLE 1

| | Charge generation material | | Hole transport material | | First electron transport material | | Second electron transport material | | Resin binder | | Inorganic filler | | | | | | | |
|---|---|---|---|---|---|---|---|---|---|---|---|---|---|---|---|---|---|---|
| | Material | Content (% by mass) | Material | Content (% by mass) | Material | Content (% by mass) | Material | Content (% by mass) | Material | Content (% by mass) | Filler material | Primary particle size | Silane coupling agent | Content (% by mass) | ΔSPa | ΔSPb | ΔSPc | ΔSPd |
| Example 1 | CG1 | 0.9 | HT1 | 22.5 | A1 | 19.4 | A2 | 2.2 | B1 | 45.0 | Silica | 10 nm | C1 | 10.0 | 1.85 | 1.35 | 0.50 | 1.72 |
| Example 2 | CG1 | 0.9 | HT1 | 22.5 | A1 | 15.2 | A2 | 6.4 | B1 | 45.0 | Silica | 10 nm | C1 | 10.0 | 1.85 | 1.35 | 0.50 | 1.72 |
| Example 3 | CG1 | 0.9 | HT1 | 22.5 | A1 | 13 | A2 | 8.6 | B1 | 45.0 | Silica | 10 nm | C1 | 10.0 | 1.85 | 1.35 | 0.50 | 1.72 |
| Example 4 | CG1 | 1.0 | HT1 | 23.8 | A1 | 20.4 | A2 | 2.3 | B1 | 47.5 | Silica | 10 nm | C1 | 5.0 | 1.85 | 1.35 | 0.50 | 1.72 |
| Example 5 | CG1 | 0.9 | HT1 | 21.2 | A1 | 18.3 | A2 | 2.1 | B1 | 42.5 | Silica | 10 nm | C1 | 15.0 | 1.85 | 1.35 | 0.50 | 1.72 |
| Example 6 | CG1 | 0.9 | HT1 | 22.5 | A1 | 19.4 | A2 | 2.2 | B1 | 45.0 | Silica | 10 nm | C2 | 10.0 | 0.88 | 0.38 | 0.50 | 1.85 |
| Example 7 | CG1 | 0.9 | HT1 | 22.5 | A1 | 19.4 | A2 | 2.2 | B2 | 45.0 | Silica | 10 nm | C4 | 10.0 | 0.25 | 0.75 | 0.50 | 1.62 |
| Example 8 | CG1 | 0.9 | HT1 | 22.5 | A1 | 19.4 | A2 | 2.2 | B4 | 45.0 | Silica | 10 nm | C4 | 10.0 | 0.25 | 0.75 | 0.50 | 0.91 |
| Example 9 | CG1 | 0.9 | HT1 | 22.5 | A1 | 19.4 | A7 | 2.2 | B1 | 45.0 | Silica | 10 nm | C2 | 10.0 | 0.88 | 1.80 | 0.92 | 1.85 |
| Example 10 | CG1 | 0.9 | HT1 | 22.5 | A1 | 19.4 | A7 | 2.2 | B2 | 45.0 | Silica | 10 nm | C4 | 10.0 | 0.25 | 0.67 | 0.92 | 1.62 |
| Example 11 | CG1 | 0.9 | HT1 | 22.5 | A1 | 19.4 | A8 | 2.2 | B1 | 45.0 | Silica | 10 nm | C2 | 10.0 | 0.88 | 1.75 | 0.87 | 1.85 |
| Example 12 | CG1 | 0.9 | HT1 | 22.5 | A1 | 19.4 | A11 | 2.2 | B1 | 45.0 | Silica | 10 nm | C1 | 10.0 | 1.85 | 2.48 | 0.63 | 1.72 |
| Example 13 | CG1 | 0.9 | HT1 | 22.5 | A2 | 19.4 | A11 | 2.2 | B1 | 45.0 | Silica | 10 nm | C1 | 10.0 | 1.85 | 2.48 | 0.63 | 1.72 |
| Example 14 | CG1 | 0.9 | HT1 | 22.5 | A5 | 13.6 | A8 | 8.6 | B1 | 45.0 | Silica | 10 nm | C2 | 10.0 | 0.84 | 1.75 | 0.91 | 1.85 |
| Example 15 | CG1 | 0.9 | HT1 | 22.5 | A5 | 13.6 | A8 | 8.6 | B3 | 45.0 | Silica | 10 nm | C4 | 10.0 | 0.29 | 0.62 | 0.91 | 1.98 |
| Comparative Example 1 | CG1 | 1.0 | HT1 | 25.0 | A1 | 24 | — | — | B1 | 50.0 | — | — | — | — | — | — | — | — |
| Comparative Example 2 | CG1 | 0.9 | HT1 | 22.5 | A1 | 19.5 | A2 | 2.1 | B1 | 55.0 | — | — | — | — | — | — | — | — |
| Comparative Example 3 | CG1 | 0.9 | HT1 | 22.5 | A1 | 21.6 | — | — | B1 | 45.0 | Silica | 10 nm | C1 | 10.0 | 1.85 | — | — | 1.72 |
| Comparative Example 4 | CG1 | 0.9 | HT1 | 22.5 | A1 | 6.5 | A2 | 15.1 | B1 | 45.0 | Silica | 10 nm | C1 | 10.0 | 1.85 | 1.35 | 0.50 | 1.72 |
| Comparative Example 5 | CG1 | 0.9 | HT1 | 22.5 | A1 | 11.5 | A3 | 10.1 | B1 | 45.0 | Silica | 10 nm | C6 | 10.0 | 2.81 | 4.02 | 1.21 | 3.10 |
| Comparative Example 6 | CG1 | 0.9 | HT1 | 22.5 | A1 | 11.5 | A5 | 10.1 | B1 | 45.0 | Silica | 10 nm | C6 | 10.0 | 2.81 | 2.85 | 0.04 | 3.10 |
| Comparative Example 7 | CG1 | 0.9 | HT1 | 22.5 | A3 | 11.5 | A4 | 10.1 | B1 | 45.0 | Silica | 10 nm | C7 | 10.0 | 2.63 | 1.44 | 1.19 | 2.02 |
| Comparative Example 8 | CG1 | 0.9 | HT1 | 22.5 | A4 | 11.5 | A8 | 10.1 | B1 | 45.0 | Silica | 10 nm | C4 | 10.0 | 0.76 | 0.62 | 0.14 | 2.13 |
| Comparative Example 9 | CG1 | 0.9 | HT1 | 22.5 | A4 | 11.5 | A8 | 10.1 | B2 | 45.0 | Silica | 10 nm | C4 | 10.0 | 0.76 | 0.62 | 0.14 | 1.62 |

TABLE 2

| | Charge generation material | | Hole transport material | | First electron transport material | | Second electron transport material | | Resin binder | | Inorganic filler | | | | | | | |
|---|---|---|---|---|---|---|---|---|---|---|---|---|---|---|---|---|---|---|
| | Material | Content (% by mass) | Material | Content (% by mass) | Material | Content (% by mass) | Material | Content (% by mass) | Material | Content (% by mass) | Filler material | Primary particle size | Silane coupling agent | Content (% by mass) | ΔSPa | ΔSPb | ΔSPc | ΔSPd |
| Example 16 | CG1 | 0.9 | HT1 | 4.5 | A1 | 38.2 | A2 | 1.4 | B1 | 45.0 | Silica | 10 nm | C1 | 10.0 | 1.85 | 1.35 | 0.50 | 1.72 |
| Example 17 | CG1 | 0.9 | HT1 | 4.5 | A1 | 29.7 | A2 | 9.9 | B1 | 45.0 | Silica | 10 nm | C1 | 10.0 | 1.85 | 1.35 | 0.50 | 1.72 |
| Example 18 | CG1 | 0.9 | HT1 | 4.5 | A1 | 23.8 | A2 | 15.8 | B1 | 45.0 | Silica | 10 nm | C1 | 10.0 | 1.85 | 1.35 | 0.50 | 1.72 |
| Example 19 | CG1 | 1.0 | HT1 | 4.8 | A1 | 31.2 | A2 | 10.5 | B1 | 47.5 | Silica | 10 nm | C1 | 5.0 | 1.85 | 1.35 | 0.50 | 1.72 |
| Example 20 | CG1 | 0.9 | HT1 | 4.3 | A1 | 22.4 | A2 | 14.9 | B1 | 42.5 | Silica | 10 nm | C1 | 15.0 | 1.85 | 1.35 | 0.50 | 1.72 |
| Example 21 | CG1 | 0.9 | HT1 | 4.5 | A1 | 29.7 | A2 | 9.9 | B1 | 45.0 | Silica | 10 nm | C2 | 10.0 | 0.88 | 0.38 | 0.50 | 1.85 |
| Example 22 | CG1 | 0.9 | HT1 | 4.5 | A1 | 29.7 | A2 | 9.9 | B2 | 45.0 | Silica | 10 nm | C4 | 10.0 | 0.25 | 0.75 | 0.50 | 1.62 |
| Example 23 | CG1 | 0.9 | HT1 | 4.5 | A1 | 29.7 | A2 | 9.9 | B4 | 45.0 | Silica | 10 nm | C4 | 10.0 | 0.25 | 0.75 | 0.50 | 0.91 |
| Example 24 | CG1 | 0.9 | HT1 | 4.5 | A1 | 29.7 | A7 | 9.9 | B1 | 45.0 | Silica | 10 nm | C2 | 10.0 | 0.88 | 1.80 | 0.92 | 1.85 |
| Example 25 | CG1 | 0.9 | HT1 | 4.5 | A1 | 29.7 | A7 | 9.9 | B2 | 45.0 | Silica | 10 nm | C4 | 10.0 | 0.25 | 0.67 | 0.92 | 1.62 |
| Example 26 | CG1 | 0.9 | HT1 | 4.5 | A1 | 29.7 | A8 | 9.9 | B1 | 45.0 | Silica | 10 nm | C2 | 10.0 | 0.88 | 1.75 | 0.87 | 1.85 |
| Example 27 | CG1 | 0.9 | HT1 | 4.5 | A1 | 29.7 | A11 | 9.9 | B1 | 45.0 | Silica | 10 nm | C1 | 10.0 | 1.85 | 2.48 | 0.63 | 1.72 |
| Example 28 | CG1 | 0.9 | HT1 | 4.5 | A2 | 29.7 | A11 | 9.9 | B1 | 45.0 | Silica | 10 nm | C1 | 10.0 | 1.85 | 2.48 | 0.63 | 1.72 |
| Example 29 | CG1 | 0.9 | HT1 | 4.5 | A5 | 29.7 | A8 | 9.9 | B1 | 45.0 | Silica | 10 nm | C2 | 10.0 | 0.84 | 1.75 | 0.91 | 1.85 |
| Example 30 | CG1 | 0.9 | HT1 | 4.5 | A5 | 29.7 | A8 | 9.9 | B3 | 45.0 | Silica | 10 nm | C4 | 10.0 | 0.29 | 0.62 | 0.91 | 1.98 |
| Comparative Example 10 | CG1 | 1.0 | HT1 | 5.0 | A1 | 44.0 | — | — | B1 | 50.0 | — | — | — | — | — | — | — | — |
| Comparative Example 11 | CG1 | 1.0 | HT1 | 5.0 | A1 | 42.5 | A2 | 1.5 | B1 | 50.0 | — | — | — | — | 1.85 | — | — | 1.72 |

TABLE 2-continued

| | Charge generation material | | Hole transport material | | First electron transport material | | Second electron transport material | | Resin binder | | Inorganic filler | | | | | | | |
|---|---|---|---|---|---|---|---|---|---|---|---|---|---|---|---|---|---|---|
| | Material | Content (% by mass) | Material | Content (% by mass) | Material | Content (% by mass) | Material | Content (% by mass) | Material | Content (% by mass) | Filler material | Primary particle size | Silane coupling agent | Content (% by mass) | ΔSPa | ΔSPb | ΔSPc | ΔSPd |
| Comparative Example 12 | CG1 | 0.9 | HT1 | 4.5 | A1 | 38.2 | A3 | 1.4 | B1 | 45.0 | Silica | 10 nm | C6 | 10.0 | 2.81 | 4.02 | 1.21 | 3.10 |
| Comparative Example 13 | CG1 | 0.9 | HT1 | 4.5 | A1 | 38.2 | A5 | 1.4 | B1 | 45.0 | Silica | 10 nm | C6 | 10.0 | 2.81 | 2.85 | 0.04 | 3.10 |
| Comparative Example 14 | CG1 | 0.9 | HT1 | 4.5 | A3 | 38.2 | A4 | 1.4 | B1 | 45.0 | Silica | 10 nm | C7 | 10.0 | 2.63 | 2.85 | 1.19 | 2.02 |
| Comparative Example 15 | CG1 | 0.9 | HT1 | 4.5 | A4 | 38.2 | A8 | 1.4 | B1 | 45.0 | Silica | 10 nm | C4 | 10.0 | 0.76 | 1.44 | 0.14 | 2.13 |
| Comparative Example 16 | CG1 | 0.9 | HT1 | 4.5 | A1 | 38.2 | A8 | 1.4 | B2 | 45.0 | Silica | 10 nm | C4 | 10.0 | 0.76 | 0.62 | 0.14 | 1.62 |
| Comparative Example 17 | CG1 | 0.9 | HT1 | 4.5 | A1 | 19.8 | A2 | 19.8 | B1 | 45.0 | Silica | 10 nm | C1 | 10.0 | 1.85 | 1.35 | 0.50 | 1.72 |
| Comparative Example 18 | CG1 | 0.9 | HT1 | 4.5 | A1 | 15.8 | A2 | 23.8 | B1 | 45.0 | Silica | 10 nm | C1 | 10.0 | 1.85 | 1.35 | 0.50 | 1.72 |
| Comparative Example 19 | CG1 | 0.9 | HT1 | 4.5 | A1 | 7.9 | A2 | 31.7 | B1 | 45.0 | Silica | 10 nm | C1 | 10.0 | 1.85 | 1.35 | 0.50 | 1.72 |
| Example 31 | CG1 | 0.9 | HT1 | 21.6 | A1 | 21.8 | A2 | 0.7 | B1 | 45.0 | Silica | 10 nm | C1 | 10.0 | 1.85 | 1.35 | 0.50 | 1.72 |
| Example 32 | CG1 | 0.9 | HT1 | 21.6 | A1 | 16.9 | A2 | 5.6 | B1 | 45.0 | Silica | 10 nm | C1 | 10.0 | 1.85 | 1.35 | 0.50 | 1.72 |
| Comparative Example 20 | CG1 | 0.7 | HT1 | 3.5 | A1 | 15.3 | A2 | 10.5 | B1 | 35.0 | Silica | 10 nm | C1 | 35.0 | 1.85 | 1.35 | 0.50 | 1.72 |

TABLE 3

| | Electrical characteristics | | Abrasion resistance | | |
|---|---|---|---|---|---|
| | Potential retention rate Vk5 (%) | Residual potential Vr5 (V) | Average abrasion amount (μm) | Evaluation of ghost image | Evaluation of print density stability |
| Example 1 | 92.4 | 26 | 2.5 | ◎ | ◎ |
| Example 2 | 92.1 | 27 | 2.8 | ◎ | ◎ |
| Example 3 | 92.5 | 27 | 2.7 | ◎ | ◎ |
| Example 4 | 92.8 | 24 | 3.6 | ◎ | ◎ |
| Example 5 | 91.6 | 28 | 2.0 | ◎ | ◎ |
| Example 6 | 92.3 | 29 | 3.1 | ◎ | ◎ |
| Example 7 | 92.4 | 22 | 2.7 | ◎ | ◎ |
| Example 8 | 93.1 | 23 | 2.9 | ◎ | ◎ |
| Example 9 | 92.3 | 24 | 2.5 | ○ | ◎ |
| Example 10 | 92.5 | 26 | 3.1 | ○ | ◎ |
| Example 11 | 92.2 | 22 | 2.9 | ○ | ◎ |
| Example 12 | 91.9 | 25 | 3.4 | ○ | ◎ |
| Example 13 | 92.4 | 25 | 2.5 | ○ | ◎ |
| Example 14 | 91.8 | 23 | 2.7 | ○ | ◎ |
| Example 15 | 92.1 | 25 | 3.1 | ○ | ◎ |
| Comparative Example 1 | 76.1 | 29 | 9.4 | X | X |
| Comparative Example 2 | 73.7 | 24 | 7.4 | ○ | ○ |
| Comparative Example 3 | 77.5 | 86 | 6.6 | X | X |
| Comparative Example 4 | 88.7 | 54 | 3.2 | X | Δ |
| Comparative Example 5 | 78.8 | 78 | 7.1 | X | X |
| Comparative Example 6 | 70.5 | 94 | 8.6 | X | X |
| Comparative Example 7 | 68.4 | 91 | 9.1 | Δ | X |
| Comparative Example 8 | 76.4 | 83 | 7.5 | Δ | X |
| Comparative Example 9 | 71.6 | 88 | 7.1 | Δ | Δ |

TABLE 4

| | Electrical characteristics | | Abrasion resistance | | |
|---|---|---|---|---|---|
| | Potential retention rate Vk5 (%) | Residual potential Vr5 (V) | Average abrasion amount (μm) | Evaluation of ghost image | Evaluation of print density stability |
| Example 16 | 92.8 | 19 | 1.8 | ◎ | ◎ |
| Example 17 | 92.4 | 21 | 1.9 | ◎ | ◎ |
| Example 18 | 92.6 | 22 | 2.2 | ◎ | ◎ |
| Example 19 | 92.4 | 22 | 2.1 | ◎ | ◎ |
| Example 20 | 92.6 | 18 | 2.7 | ◎ | ◎ |
| Example 21 | 92.1 | 26 | 1.5 | ◎ | ◎ |
| Example 22 | 93.5 | 30 | 2.0 | ◎ | ◎ |
| Example 23 | 92.4 | 24 | 2.3 | ◎ | ◎ |
| Example 24 | 92.3 | 26 | 2.1 | ○ | ◎ |
| Example 25 | 92 | 25 | 2.2 | ○ | ◎ |
| Example 26 | 92.5 | 26 | 2.0 | ○ | ◎ |
| Example 27 | 92.2 | 21 | 1.8 | ○ | ◎ |
| Example 28 | 92.7 | 29 | 2.4 | ○ | ◎ |
| Example 29 | 92.3 | 22 | 2.2 | ○ | ◎ |
| Example 30 | 92.6 | 19 | 2.2 | ○ | ◎ |
| Comparative Example 10 | 73.6 | 30 | 7.1 | X | X |
| Comparative Example 11 | 71.4 | 24 | 6.8 | ◎ | ◎ |
| Comparative Example 12 | 69.4 | 67 | 6.1 | X | X |
| Comparative Example 13 | 72.6 | 76 | 5.9 | X | X |
| Comparative Example 14 | 70.9 | 85 | 4.9 | Δ | X |
| Comparative Example 15 | 74.9 | 73 | 6.4 | Δ | X |
| Comparative Example 16 | 76.8 | 81 | 5.7 | Δ | Δ |
| Comparative Example 17 | 83.4 | 41 | 2.1 | Δ | Δ |
| Comparative Example 18 | 79.1 | 35 | 2.1 | Δ | X |
| Comparative Example 19 | 78.8 | 41 | 2.3 | Δ | X |
| Example 31 | 67.9 | 46 | 2.0 | ○ | Δ |
| Example 32 | 69.4 | 43 | 1.9 | ○ | Δ |
| Comparative Example 20 | 65.7 | 83 | 3.7 | X | Δ |

As is apparent from the results in Tables 3 and 4 shown above, favorable abrasion resistance, favorable electrical properties of a photoconductor, and reduced generation of ghost images were confirmed for the photoconductors of Examples 1 to 32 in which a combination of two types of electron transport materials that satisfies the above-described Hansen solubility parameter, a resin binder, and an inorganic oxide filler surface-treated with a silane coupling agent was used for the photosensitive layer, compared with the photoconductor of each of the Comparative Examples in which a combination different therefrom was used. In each of the Examples, favorable results were also obtained for the environmental stability of print density.

Based on the results of the Example, it was found that a naphthalenetetracarboxylic diimide compound, an azoquinone compound, bisphenol Z or bisphenol Z-biphenyl copolymer, silica fine particles, a compound represented by the structural formula C1, C2, or C4 are particularly suitable as a first electron transport material, a second electron transport material, a resin binder, an inorganic oxide filler, and a silane coupling agent, respectively.

DESCRIPTION OF SYMBOLS

1 Conductive substrate;
2 Undercoat layer;
2A Alumite layer;
2B Resin layer;
3 Single-layered photosensitive layer;
4 Charge transport layer;
5 Charge generation layer;
6 Multi-layered photosensitive layer;
7, 8 Photoconductor;
21, 31 Charging member;
22 High voltage power supply;
23, 33 Image exposure member;
24 Developing unit;
241 Developing roller;
25 Paper feeding member;
251 Paper feeding roller;
252 Paper feeding guide;
26 Transfer charger (direct charging type);
27 Cleaning device;
271 Cleaning blade;
28 Discharging member;

32 Power supply;
34 Developing member;
35 Transfer member;
36 Cleaning member;
60, 70 Electrophotographic device; and
300 Photosensitive layer.

What is claimed is:

1. An electrophotographic photoconductor, comprising:

a conductive substrate; and a photosensitive layer provided on the conductive substrate and containing a charge generation material, a hole transport material, a first electron transport material, a second electron transport material, a resin binder, and an inorganic oxide filler surface-treated with a silane coupling agent, wherein the first electron transport material and the silane coupling agent have a difference ΔSPa in a dipole-dipole force component, that is a Hansen solubility parameter, between the first electron transport material and the silane coupling agent that satisfies a relationship of ΔSPa<2.50, wherein the second electron transport material and the silane coupling agent have a difference ΔSPb in a dipole-dipole force component, that is a Hansen solubility parameter, between the second electron transport material and the silane coupling agent that satisfies a relationship of ΔSPb<2.50, wherein the first electron transport material and the second electron transport material have a difference ΔSPc in a dipole-dipole force component, that is a Hansen solubility parameter, between the first electron transport material and the second electron transport material that satisfies a relationship of 0.30<ΔSPc<1.00, wherein the resin binder and the silane coupling agent have a difference ΔSPd in a London dispersion force component, that is a Hansen solubility parameter, between the resin binder and the silane coupling agent that satisfies a relationship of ΔSPd<2.00, and wherein the second electron transport material is present in an amount ranging from 3% by mass to 40% by mass with respect to combined content of the first electron transport material and the second electron transport material.

2. The electrophotographic photoconductor according to claim 1, wherein the first electron transport material and the second electron transport material are selected from compounds represented by general formulas (ET1) and (ET2) as follows:

(ET1)

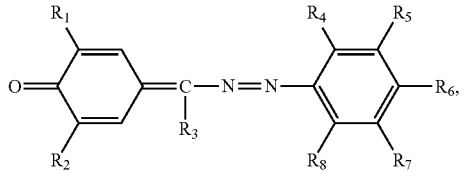

where $R_1$ and $R_2$ are the same or different and each represent a hydrogen atom, an alkyl group having 1 to 12 carbon atoms, an alkoxy group having 1 to 12 carbon atoms, an aryl group which may have a substituent, a cycloalkyl group, an aralkyl group which may have a substituent, or an alkyl halide group, $R_3$ represents a hydrogen atom, an alkyl group having 1 to 6 carbon atoms, an alkoxy group having 1 to 6 carbon atoms, an aryl group which may have a substituent, a cycloalkyl group, an aralkyl group which may have a substituent, or an alkyl halide group, where $R_4$ to $R_8$ are the same or different and each represent a hydrogen atom, a halogen atom, an alkyl group having 1 to 12 carbon atoms, an alkoxy group having 1 to 12 carbon atoms, an aryl group which may have a substituent, an aralkyl group which may have a substituent, a phenoxy group which may have a substituent, an alkyl halide group, a cyano group, or a nitro group with a condition that two or more groups may be combined to form a ring, and each substituent represents a halogen atom, an alkyl group having 1 to 6 carbon atoms, an alkoxy group having 1 to 6 carbon atoms, a hydroxyl group, a cyano group, an amino group, a nitro group, or an alkyl halide group; and (ET2)

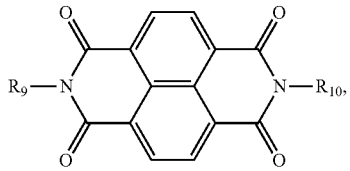

where $R_9$ and $R_{10}$ are the same or different and each represent a hydrogen atom, a halogen atom, a cyano group, a nitro group, a hydroxyl group, an alkyl group having 1 to 12 carbon atoms, an alkoxy group having 1 to 12 carbon atoms, an aryl group which may have a substituent, a heterocyclic group which may have a substituent, an ester group, a cycloalkyl group, an aralkyl group which may have a substituent, an allyl group, an amide group, an amino group, an acyl group, an alkenyl group, an alkynyl group, a carboxyl group, a carbonyl group, a carboxylic acid group, or an alkyl halide group, and each substituent represents a halogen atom, an alkyl group having 1 to 6 carbon atoms, an alkoxy group having 1 to 6 carbon atoms, a hydroxyl group, a cyano group, an amino group, a nitro group, or an alkyl halide group.

3. The electrophotographic photoconductor according to claim 2, wherein the inorganic oxide filler has a primary particle size ranging from 1 nm to 300 nm.

4. The electrophotographic photoconductor according to claim 2, wherein the photosensitive layer consists of a single layer containing the charge generation material, the hole transport material, the first electron transport material, the second electron transport material, the resin binder, and the inorganic oxide filler.

5. The electrophotographic photoconductor according to claim 4, wherein the first electron transport material and the second electron transport material are present in a combined content E (% by mass) in a total solid content of the photosensitive layer, and wherein the inorganic oxide filler is present in a content F (% by mass) in the total solid content of the photosensitive layer that is smaller than the combined content E (% by mass) of the first electron transport material and the second electron transport material, and the content F satisfies a relationship of 2≤F≤15.

6. The electrophotographic photoconductor according to claim 1, wherein the first electron transport material and the second electron transport material are compounds represented by structural formulas (A1) and (A2) as follows:

(A1)

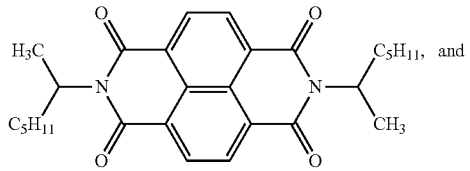

(A2)

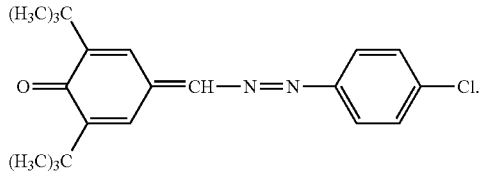

7. The electrophotographic photoconductor according to claim 6, wherein the inorganic oxide filler has a primary particle size ranging from 1 nm to 300 nm.

8. The electrophotographic photoconductor according to claim 6, wherein the photosensitive layer consists of a single layer containing the charge generation material, the hole transport material, the first electron transport material, the second electron transport material, the resin binder, and the inorganic oxide filler.

9. The electrophotographic photoconductor according to claim 8, wherein the first electron transport material and the second electron transport material are present in a combined content E (% by mass) in a total solid content of the photosensitive layer, and wherein the inorganic oxide filler is present in a content F (% by mass) in the total solid content of the photosensitive layer that is smaller than the combined content E (% by mass) of the first electron transport material and the second electron transport material, and the content F satisfies a relationship of $2 \leq F \leq 15$.

10. The electrophotographic photoconductor according to claim 1, wherein the inorganic oxide filler has a primary particle size of from 1 nm to 300 nm.

11. The electrophotographic photoconductor according to claim 10, wherein the photosensitive layer consists of a single layer containing the charge generation material, the hole transport material, the first electron transport material, the second electron transport material, the resin binder, and the inorganic oxide filler.

12. The electrophotographic photoconductor according to claim 11, wherein the first electron transport material and the second electron transport material are present in a combined content E (% by mass) in a total solid content of the photosensitive layer, and wherein the inorganic oxide filler is present in a content F (% by mass) in the total solid content of the photosensitive layer that is smaller than the combined content E (% by mass) of the first electron transport material and the second electron transport material, and the content F satisfies a relationship of $2 \leq F \leq 15$.

13. The electrophotographic photoconductor according to claim 1, wherein the photosensitive layer consists of a single layer containing the charge generation material, the hole transport material, the first electron transport material, the second electron transport material, the resin binder, and the inorganic oxide filler.

14. The electrophotographic photoconductor according to claim 13, wherein the first electron transport material and the second electron transport material are present in a combined content E (% by mass) in a total solid content of the photosensitive layer, and wherein the inorganic oxide filler is present in a content F (% by mass) in the total solid content of the photosensitive layer that is smaller than the combined content E (% by mass) of the first electron transport material and the second electron transport material, and the content F satisfies a relationship of $2 \leq F \leq 15$.

15. The electrophotographic photoconductor according to claim 1, wherein the photosensitive layer includes a charge transport layer and a charge generation layer layered disposed in that order on the conductive substrate, and the charge generation layer contains the charge generation material, the hole transport material, the first electron transport material, the second electron transport material, the resin binder, and the inorganic oxide filler.

16. The electrophotographic photoconductor according to claim 15, wherein the first electron transport material and the second electron transport material are present in a combined content E (% by mass) in a total solid content of the charge generation layer, and wherein the inorganic oxide filler is present in a content F (% by mass) in the total solid content of the charge generation layer that is smaller than the combined content E (% by mass) of the first electron transport material and the second electron transport material, and the content F satisfies a relationship of $2 \leq F \leq 15$.

17. The electrophotographic photoconductor according to claim 16, wherein the hole transport material is present in a content H (% by mass) in a solid content of the charge generation layer, and wherein the first electron transport material and the second electron transport material are present in a combined content E (% by mass) in the solid content of the charge generation layer that is larger than the content H (% by mass) of the hole transport material, and the combined content E and the content H satisfy $1.5 \leq E/H \leq 10.0$.

18. The electrophotographic photoconductor according to claim 15, wherein the hole transport material is present in a content H (% by mass) in a solid content of the charge generation layer, and wherein the first electron transport material and the second electron transport material are present in a combined content E (% by mass) in the solid content of the charge generation layer that is larger than the content H (% by mass) of the hole transport material, and the combined content E and the content H satisfy $1.5 \leq E/H \leq 10.0$.

19. A method of manufacturing an electrophotographic photoconductor according to claim 1, comprising:

providing a coating solution containing the charge generation material, the hole transport material, the first electron transport material, the second electron transport material, the resin binder, and the inorganic oxide filler surface-treated with a silane coupling agent;

dip coating the conductive substrate into the coating solution to provide a coating; and drying the coating to forming the photosensitive layer.

20. An electrophotographic device comprising the electrophotographic photoconductor according to claim 1.

* * * * *